US008337008B2

(12) United States Patent
Kachi

(10) Patent No.: US 8,337,008 B2
(45) **Date of Patent: *Dec. 25, 2012**

(54) INKJET RECORDING APPARATUS AND INKJET RECORDING METHOD

(75) Inventor: Yasuhiko Kachi, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 441 days.

This patent is subject to a terminal disclaimer.

(21) Appl. No.: 12/404,905

(22) Filed: Mar. 16, 2009

(65) Prior Publication Data

US 2009/0231377 A1 Sep. 17, 2009

(30) Foreign Application Priority Data

Mar. 17, 2008 (JP) ..... 2008-067448

(51) Int. Cl.
*B41J 2/01* (2006.01)

(52) U.S. Cl. ..... 347/103; 347/104; 347/101

(58) Field of Classification Search ..... 347/104, 347/101, 103, 102; 271/314, 315, 306
See application file for complete search history.

(56) References Cited

U.S. PATENT DOCUMENTS

| | | | | |
|---|---|---|---|---|
| 5,771,054 | A | 6/1998 | Dudek et al. | |
| 5,816,155 | A | 10/1998 | Stephan | |
| 6,378,425 | B1 | 4/2002 | Stephan | |
| 6,659,602 | B2 | 12/2003 | Izawa et al. | |
| 6,983,696 | B2 | 1/2006 | Koch et al. | |
| 7,506,975 | B2 | 3/2009 | Cellura et al. | |
| 7,524,005 | B2 | 4/2009 | Inoue | |
| 7,722,180 | B2 | 5/2010 | Mashima | |
| 7,726,802 | B2 | 6/2010 | Morimoto | |
| 2002/0084581 | A1 | 7/2002 | Schaum | |
| 2003/0210313 | A1 | 11/2003 | Nedblake, Jr. et al. | |
| 2005/0193906 | A1* | 9/2005 | Nakamura et al. | 101/211 |
| 2006/0009544 | A1 | 1/2006 | Miyagawa et al. | |
| 2007/0008394 | A1* | 1/2007 | Mashima | 347/104 |
| 2008/0098910 | A1* | 5/2008 | Koto et al. | 101/118 |
| 2009/0053409 | A1* | 2/2009 | Yamamoto et al. | 428/32.18 |
| 2009/0079784 | A1* | 3/2009 | Chiwata et al. | 347/21 |
| 2009/0231377 | A1 | 9/2009 | Kachi | |
| 2009/0231407 | A1* | 9/2009 | Kachi | 347/104 |
| 2009/0244237 | A1* | 10/2009 | Kachi | 347/104 |
| 2009/0291215 | A1* | 11/2009 | Makuta et al. | 427/256 |

(Continued)

FOREIGN PATENT DOCUMENTS

| | | | |
|---|---|---|---|
| JP | 3-169644 | A | 7/1991 |

(Continued)

*Primary Examiner* — Manish S Shah
(74) *Attorney, Agent, or Firm* — Birch, Stewart, Kolasch & Birch, LLP

(57) ABSTRACT

An inkjet recording apparatus has: an inkjet head which ejects ink so as to record an image on a recording surface of a recording medium; a drum-shaped member which includes a drum, holds an edge of the recording medium, and conveys the recording medium in close contact with a circumferential surface of the drum; an intermediate conveyance body which holds an edge of the recording medium while moving the recording medium in rotation, and transfers the recording medium to the drum-shaped member; and a conveyance guide which guides a non-recording surface of the recording medium which is moved in rotation by the intermediate conveyance body, wherein the conveyance guide has a back tension application device which produces a force to act on the recording medium in an opposite direction to a direction of movement of the recording medium.

11 Claims, 16 Drawing Sheets

U.S. PATENT DOCUMENTS

2009/0311426 A1* 12/2009 Nakazawa et al. ..... 347/102

FOREIGN PATENT DOCUMENTS

| | | | |
|---|---|---|---|
| JP | 4-18462 | A | 1/1992 |
| JP | 8-244206 | A | 9/1996 |
| JP | 10-138526 | A | 5/1998 |
| JP | 2000-168047 | A | 6/2000 |
| JP | 2001-293858 | A | 10/2001 |
| JP | 2002-292956 | A | 10/2002 |
| JP | 2004-90596 | A | 3/2004 |
| JP | 2005-134631 | A | 5/2005 |
| JP | 2005-138336 | A | 6/2005 |
| JP | 2006-37088 | A | 2/2006 |
| JP | 2006-264068 | A | 10/2006 |
| JP | 2007-15130 | A | 1/2007 |
| JP | 2007-160879 | A | 6/2007 |
| JP | 2007-216456 | A | 8/2007 |
| JP | 2007-217508 | A | 8/2007 |
| JP | 2007-261206 | A | 10/2007 |

* cited by examiner

INKJET RECORDING APPARATUS AND INKJET RECORDING METHOD

BACKGROUND OF THE INVENTION

1. Field of the Invention

The present invention relates to an inkjet recording apparatus and an inkjet recording method, and more particularly, to an inkjet recording apparatus and an inkjet recording method whereby wrinkling and curling of a recording medium on the circumference of a drum-shaped member are prevented by producing a force (back tension) to act in the direction opposite to the direction of movement of the recording medium on the trailing edge of the recording medium, when a recording medium is conveyed by being held in close contact on a drum-shaped member, such as a printing drum, fixing drum, or the like.

2. Description of the Related Art

Japanese Patent Application Publication No. 2002-292956 discloses a cut sheet rotary printing machine which comprises a holding apparatus for holding cut sheet paper, a rotatably composed conveyance drum which conveys cut sheet paper, and a NIP (non-impact printing) print head, opposing the conveyance drum, which prints onto the cut sheet paper.

It is disclosed that a paper supply drum transfers the cut sheet paper to the conveyance drum, and only the leading edge of the cut sheet paper is held when the cut sheet paper is conveyed in close contact with the circumferential surface of the conveyance drum.

However, in the invention disclosed in Japanese Patent Application Publication No. 2002-292956, although the leading edge of the cut sheet paper of printing medium in terms of the direction of conveyance of the sheet is suctioned and held on the circumference of the conveyance drum during the conveyance of the cut sheet paper on the circumference of the conveyance drum, a back tension does not act on the trailing edge of the cut sheet paper of printing medium in terms of the direction of conveyance of the sheet.

Therefore, wrinkling and curling occurs in the cut sheet paper which is conveyed on the circumference of the conveyance drum. If wrinkling and curling of the recording medium, such as cut sheet paper, occurs in this way, then the quality of the image formed on the recording medium declines.

SUMMARY OF THE INVENTION

The present invention has been contrived in view of these circumstances, an object thereof being to provide an inkjet recording apparatus and an inkjet recording method whereby wrinkling and curling of a recording medium on the circumference of a drum-shaped member is prevented.

In order to attain an object described above, one aspect of the present invention is directed to an inkjet recording apparatus comprising: an inkjet head which ejects ink so as to record an image on a recording surface of a recording medium; a drum-shaped member which includes a drum, holds an edge of the recording medium, and conveys the recording medium in close contact with a circumferential surface of the drum; an intermediate conveyance body which holds an edge of the recording medium while moving the recording medium in rotation, and transfers the recording medium to the drum-shaped member; and a conveyance guide which guides a non-recording surface of the recording medium which is moved in rotation by the intermediate conveyance body, wherein the conveyance guide has a back tension application device which produces a force to act on the recording medium in an opposite direction to a direction of movement of the recording medium.

According to this aspect of the invention, when a recording medium is conveyed in close contact on the circumference of the drum-shaped member, the rotational movement is guided while applying a force to the recording medium in the opposite direction to the direction of movement by the back tension application device, and therefore it is possible to prevent the occurrence of wrinkling and curling of the recording medium on the circumference of the drum-shaped member, thus improving the quality of the image which is formed on the recording surface of the recording medium.

Desirably, the back tension application device is a pressure application device which applies a pressure to the recording medium.

According to this aspect of the invention, when conveying a recording medium in close contact on the circumference of the drum-shaped member, since the rotational movement is guided while applying a pressure by the pressure application device, it is possible to prevent the occurrence of wrinkling and curling of the recording medium on the circumference of the drum-shaped member and hence the quality of the image formed on the recording surface of the recording medium is improved.

Desirably, the pressure application device is a negative pressure application device which is provided in the conveyance guide and which applies a negative pressure to the non-recording surface of the recording medium.

According to this aspect of the invention, when conveying a recording medium in close contact on the circumference of the drum-shaped member, since the rotational movement is guided while applying a negative pressure to the non-recording surface by the negative pressure application device, it is possible to prevent the occurrence of wrinkling and curling of the recording medium on the circumference of the drum-shaped member and hence the quality of the image formed on the recording surface of the recording medium is improved.

Desirably, the inkjet recording apparatus comprises a negative pressure control device which controls the negative pressure applied to the recording medium by the negative pressure application device.

According to this aspect of the invention, by controlling the negative pressure when the recording medium is conveyed in close contact on the circumference of the drum-shaped member, the rotational movement of the recording medium is guided while applying a negative pressure to the non-recording surface in a more reliable fashion, by controlling the negative pressure.

Desirably, the negative pressure control device controls magnitude of the negative pressure applied by the negative pressure application device in accordance with a type of the recording medium.

According to this aspect of the invention, by controlling the negative pressure when the recording medium is conveyed in close contact on the circumference of the drum-shaped member, the rotational movement of the recording medium is guided while applying a negative pressure to the non-recording surface in a more reliable fashion, in accordance with the type of the recording medium.

Desirably, the pressure application device is a positive pressure application device which is provided in the intermediate conveyance body and which applies a positive pressure to the recording surface of the recording medium.

According to this aspect of the invention, when conveying a recording medium in close contact on the circumference of a drum-shaped member, since the rotational movement is guided while applying a positive pressure to the recording surface by means of the positive pressure application device, it is possible to prevent the occurrence of wrinkling and curling of the recording medium on the circumference of the drum-shaped member and hence the quality of the image formed on the recording surface of the recording medium is improved.

Desirably, the positive pressure application device has a positive pressure restricting device which partially restricts the positive pressure applied to the recording surface of the recording medium.

According to this aspect of the invention, it is possible to make the recording medium move in rotation following the conveyance guide in a more reliable fashion, by means of positive pressure.

Desirably, the inkjet recording apparatus comprises a positive pressure control device which controls the positive pressure applied to the recording medium by the positive pressure application device.

According to this aspect of the invention, by controlling the positive pressure when the recording medium is conveyed in close contact on the circumference of the drum-shaped member, the rotational movement of the recording medium is guided while applying a positive pressure to the recording surface in a more reliable fashion, by controlling the positive pressure.

Desirably, the positive pressure control device controls magnitude of the positive pressure applied by the positive pressure application device in accordance with a type of the recording medium.

According to this aspect of the invention, by controlling the positive pressure when the recording medium is conveyed in close contact on the circumference of the drum-shaped member, the rotational movement of the recording medium is guided while applying a positive pressure to the recording surface in a more reliable fashion, in accordance with the type of recording medium.

Desirably, the drum-shaped member is a print drum in which the inkjet head is arranged opposing the circumferential surface of the drum.

According to this aspect of the invention, when the recording medium is conveyed in close contact with the circumference of the print drum, the rotational movement is guided while applying a back tension to the recording medium by means of the back tension application device, and therefore, it is possible to prevent the occurrence of wrinkling and curling of the recording medium on the circumference of the print drum.

Desirably, the drum-shaped member is a fixing drum having a fixing device which fixes an image on the recording surface of the recording medium and which is arranged opposing the circumferential surface of the drum.

According to this aspect of the invention, when the recording medium is conveyed in close contact with the circumference of the fixing drum, the rotational movement is guided while applying a back tension to the recording medium by means of the back tension application device, and therefore, it is possible to prevent the occurrence of wrinkling and curling of the recording medium on the circumference of the fixing drum.

Desirably, the drum-shaped member is a drying drum having a drying device which dries an image on the recording surface of the recording medium and which is arranged opposing the circumferential surface of the drum.

According to this aspect of the invention, when the recording medium is conveyed in close contact with the circumference of the drying drum, the rotational movement is guided while applying a back tension to the recording medium by means of the back tension application device, and therefore, it is possible to prevent the occurrence of wrinkling and curling of the recording medium on the circumference of the drying drum.

Desirably, the drum-shaped member has a contacting device which causes the recording medium to make close contact with the circumferential surface of the drum.

According to this aspect of the invention, it is possible to prevent the occurrence of wrinkling and curling of the recording medium on the circumferential surface of the drum-shaped member, in a more reliable fashion.

Desirably, the contacting device has a suction device which suctions the recording medium onto the circumferential surface of the drum.

According to this aspect of the invention, the recording medium is suctioned to make close contact with the circumferential surface of the drum-shaped member, and hence it is possible to prevent the occurrence of wrinkling and curling of the recording medium in a more reliable fashion.

In order to attain an object described above, another aspect of the present invention is directed to an inkjet recording apparatus comprising: an inkjet head which ejects ink so as to record an image on a recording medium; a drum-shaped member which includes a drum and is at least one of a print drum in which the inkjet head is arranged opposing a circumferential surface of the drum, a drying drum having a drying device which dries an image on a recording surface of the recording medium and which is arranged opposing the circumferential surface of the drum, and a fixing drum having a fixing device which fixes an image on the recording surface of the recording medium and which is arranged opposing the circumferential surface of the drum; an intermediate conveyance body which holds an edge of the recording medium while moving the recording medium in rotation, and transfers the recording medium to the drum-shaped member; and a conveyance guide which guides a non-recording surface of the recording medium which is moved in rotation by the intermediate conveyance body, wherein the conveyance guide has a back tension application device which produces a force to act on the recording medium in an opposite direction to a direction of movement of the recording medium.

In order to attain an object described above, another aspect of the present invention is directed to an inkjet recording method comprising the steps of: ejecting ink on a recording medium so as to record an image on the recording medium; and moving the recording medium in rotation in a state where an edge of the recording medium is held while a non-recording surface of the recording medium is guided, in such a manner that the recording medium is transferred onto a drum-shaped member including a drum, wherein when the drum-shaped member holds an edge of the recording medium and conveys the recording medium in close contact with a circumferential surface of the drum, a force is produced to act in a direction opposite to a direction of movement of the recording medium.

According to the present invention, it is possible to prevent the occurrence of wrinkling and curling of a recording medium on the circumference of a drum-shaped member, such as a print drum or a fixing drum.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 13B is a cross-sectional diagram along line 13B-13B in FIG. 13A);

DETAILED DESCRIPTION OF THE PREFERRED EMBODIMENTS

First Embodiment

General Composition of Inkjet Recording Apparatus

Firstly, the overall composition of an inkjet recording apparatus according to an embodiment of the present invention will be described.

Figure 1:
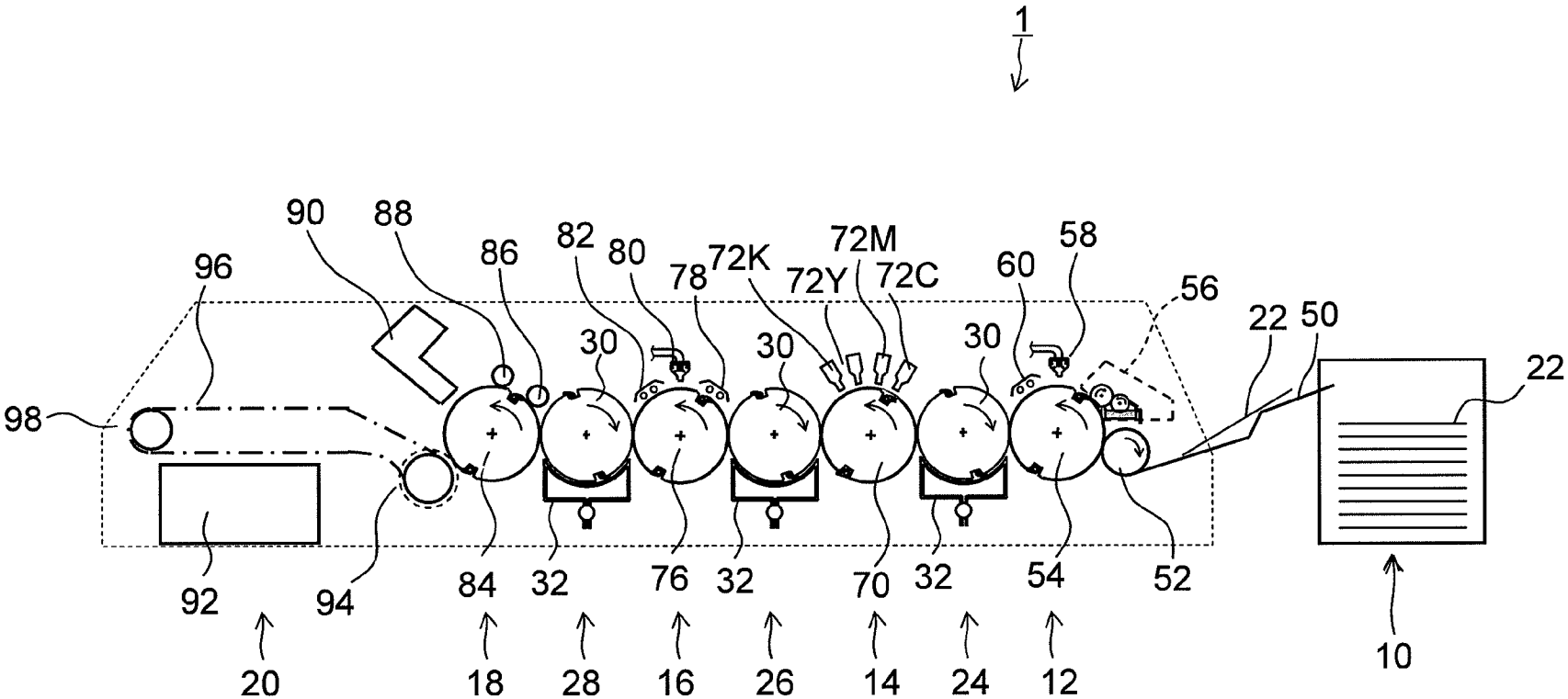
FIG. 1 is a general schematic drawing of an inkjet recording apparatus according to a first embodiment of the invention.

FIG. 1 is a general schematic drawing of an inkjet recording apparatus according to a first embodiment of the present invention. As illustrated in FIG. 1, the inkjet recording apparatus 1 according to the present embodiment is an inkjet recording apparatus using a drum-based direct printing method, which is one mode of a direct printing method of forming an image directly on a recording medium.

The inkjet recording apparatus 1 principally comprises, in order from the upstream side in terms of the direction of conveyance of a recording medium 22: a paper supply unit 10 which supplies recording media 22 (cut sheet paper); a treatment liquid deposition unit 12 which deposits a treatment liquid onto the recording surface of a recording medium 22 and dries the liquid; a print unit 14 which forms an image by depositing colored inks onto the recording surface of the recording medium 22; a drying unit 16 which dries the solvent of the colored inks; a fixing unit 18 which makes the image fix securely; and an output unit 20 which conveys and outputs the recording medium 22 on which an image has been formed. In this way, the inkjet recording apparatus 1 has a composition in which the respective image forming processes are disposed in respective units. A first intermediate conveyance unit 24 is provided between the treatment liquid deposition unit 12 and the print unit 14, a second intermediate conveyance unit 26 is provided between the print unit 14 and the drying unit 16, and a third intermediate conveyance unit 28 is provided between the drying unit 16 and the fixing unit 18.

Paper Supply Unit

The paper supply unit 10 is a mechanism which supplies recording media 22 to the treatment liquid deposition unit 12. A paper supply tray 50 is provided in the paper supply unit 10 and a recording medium 22 is supplied from the paper supply tray 50 to the treatment liquid deposition unit 12.

Treatment Liquid Deposition Unit

The treatment liquid deposition unit 12 has a mechanism which deposits onto the recording surface of the recording medium 22, a treatment liquid containing a coloring material aggregating agent which causes the coloring material contained in the ink to aggregate.

As illustrated in FIG. 1, the treatment liquid deposition unit 12 comprises a transfer drum 52 and a treatment liquid drum 54, and a treatment liquid application apparatus 56, a hot air blowing nozzle 58, and an infrared heater 60 are disposed at positions opposing the circumferential surface of the treatment liquid drum 54, in sequence from the upstream side in terms of the direction of rotation (direction of movement) of the treatment liquid drum 54 (the counter-clockwise direction in FIG. 1).

The transfer drum 52 is a drum for receiving a recording medium 22 from the paper supply tray 50 of the paper supply unit 10 and transferring the recording medium 22 to the treatment liquid drum 54. It is also possible to provide an intermediate conveyance unit as described below, instead of the transfer drum 52.

The treatment liquid drum 54 is a drum for holding a recording medium 22 and conveying the medium by rotation. The treatment liquid application apparatus 56 is an apparatus for applying treatment liquid to the recording surface of the recording medium 22. The hot air blowing nozzle 58 and the infrared heater 60 are drying devices for drying the solvent of the treatment liquid which has been applied to the recording surface of the recording medium 22.

The treatment liquid drum 54 holds the leading edge of the recording medium 22 by means of a hook-shaped holding device (a device similar to the holding device 73 in FIG. 4, which is described hereinafter) provided on the outer circumferential side of the drum. The treatment liquid drum 54 may also have suction holes provided in the outer circumferential side thereof, in order to hold the recording medium 22 in close contact by suctioning via the suction holes.

Figure 2:
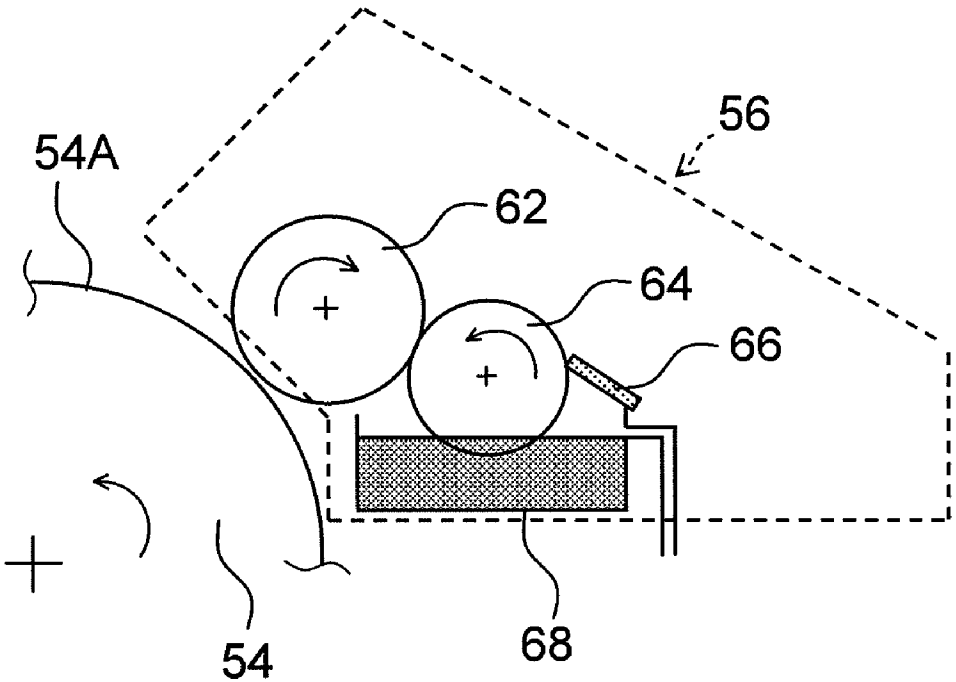
FIG. 2 is a schematic drawing of a treatment liquid application apparatus.

FIG. 2 is a schematic drawing of the treatment liquid application apparatus 56. As illustrated in FIG. 2, the treatment liquid application apparatus 56 comprises a rubber roller 62, an anilox roller 64, a squeegee 66, a treatment liquid container 68, and the like. The treatment liquid application apparatus 56 regulates the treatment liquid application volume by means of the anilox roller 64 which is partially immersed in the treatment liquid in the treatment liquid container 68, and the squeegee 66 which presses against the anilox roller 64. The rubber roller 62 which presses against the anilox roller 64 is pressed against the rotating treatment liquid drum 54 and is thereby driven to rotate at a prescribed uniform speed in the opposite direction to the direction of rotation of the treatment liquid drum 54 (the clockwise direction in FIG. 1), thus applying treatment liquid to the recording surface side of the recording medium 22.

Desirably, the thickness of the film of treatment liquid is sufficiently smaller than the diameter of the liquid droplets of ink which are ejected from the ink heads 72C, 72M, 72Y and 72K of the print unit 14 (see FIG. 1). For example, if the droplet ejection volume of the ink is 2 pl, then the average diameter of the liquid droplets is 15.6 μm. In this case, if the thickness of the film of treatment liquid is large, then the ink dots can float in the treatment liquid rather than making contact with the surface of the recording medium 22. Therefore, in order to obtain a deposited dot diameter of 30 μm or greater when the ink droplet ejection volume is 2 pl, it is desirable that the thickness of the film of treatment liquid should be 3 μm or less.

Figure 3:
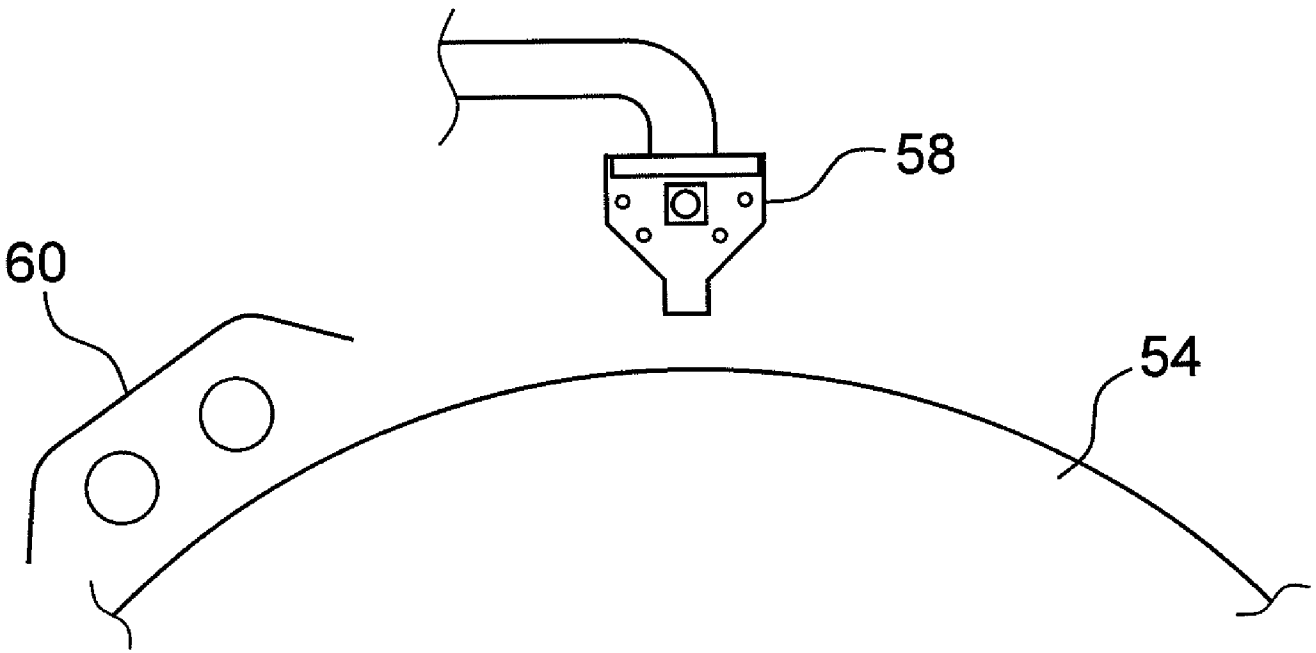
FIG. 3 is a diagram of the arrangement of a treatment liquid drum, a hot air blowing nozzle, and an infrared heater in a treatment liquid deposition unit.

FIG. 3 is a diagram illustrating the configuration of the hot air blowing nozzle 58 and the infrared heater 60. The hot air blowing nozzle 58 and the infrared heater 60 which are disposed about the treatment liquid drum 54 to the downstream side in terms of the direction of conveyance of the recording medium 22 are devices which dry the moisture content of the treatment liquid solvent, and thereby form a solid layer or a thin film layer of treatment liquid on the recording surface of the recording medium 22. By forming a thin layer of treatment liquid in this way, when the ink dots formed by droplets ejected by the print unit 14 make contact with the recording surface of the recording medium 22, the required dot diameter is obtained, and furthermore, aggregation of the coloring material occurs due to reaction with the treatment liquid component that has been formed in a thin layer, and hence an action of fixing the coloring material to the recording surface of the recording medium 22 is readily achieved.

For example, the temperature of the treatment liquid drum 54 is set to 50° C., the temperature of the infrared heater 60 is set to 180° C., the temperature of the hot air from the hot air blowing nozzle 58 is set to 70° C., and the flow rate of the hot air from the hot air blowing nozzle 58 is set to 9 $m^3$/minute.

Print Unit

Figure 4:
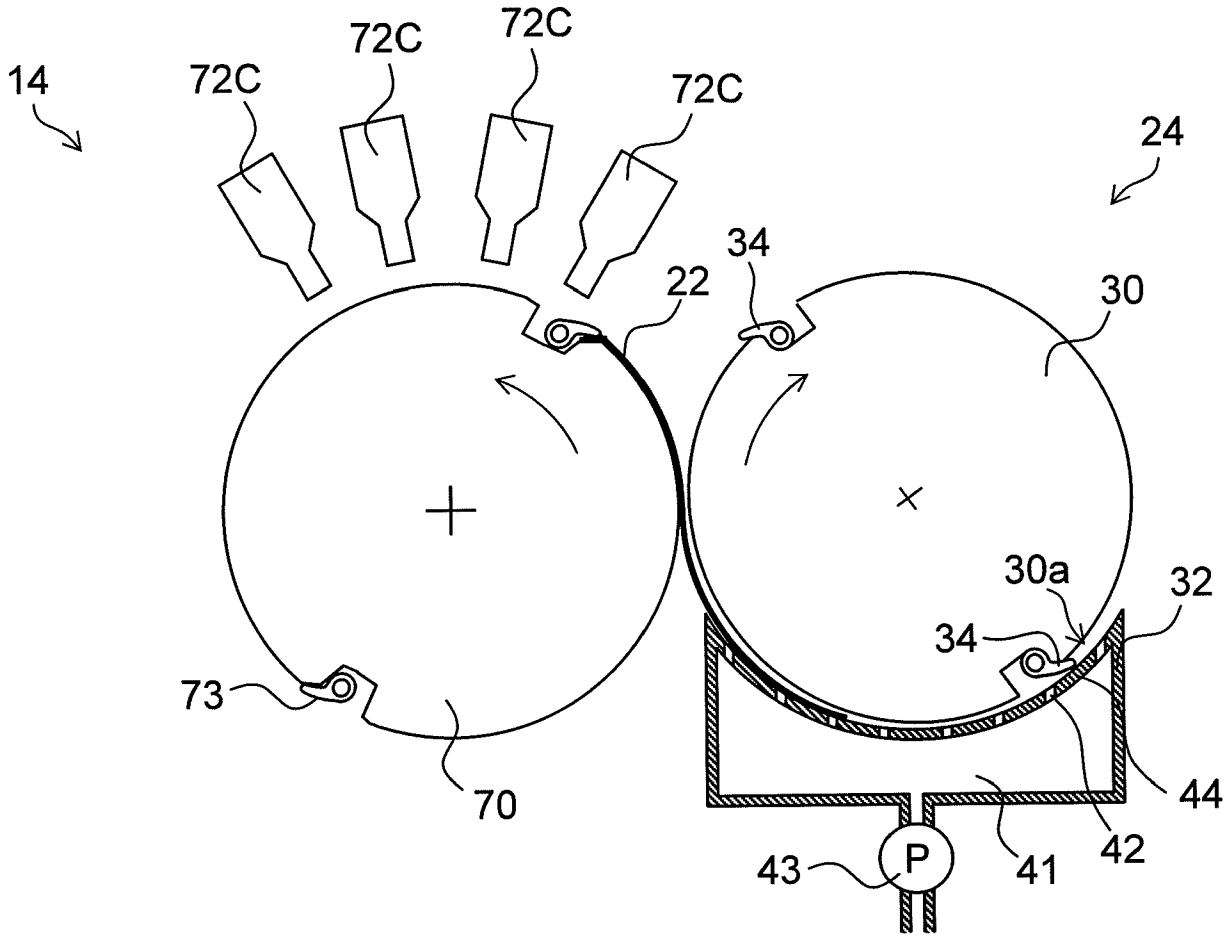
FIG. 4 is a schematic drawing of a first intermediate conveyance unit, a print drum and an ink head.

As illustrated in FIG. 4, the print unit 14 comprises a print drum 70, and ink heads 72C, 72M, 72Y and 72K corresponding respectively to inks of the four colors of cyan (C), magenta (M), yellow (Y) and black (K) are disposed in close proximity at positions opposing the outer circumferential surface of the print drum 70, in the stated order from the upstream side in terms of the direction of rotation of the print drum 70 (the counter-clockwise direction in FIG. 4).

The print drum 70 is a drum which comprises, on the outer circumferential surface thereof, holding devices 73 for conveying the recording medium 22 in rotation by holding the leading edge of the recording medium 22 in the direction of conveyance of the medium. The ink heads 72C, 72M, 72Y and 72K are ink deposition devices which deposit ink onto the recording surface of the recording medium 22.

As illustrated in FIG. 4, the ink heads 72C, 72M, 72Y and 72K each have a length corresponding to the maximum width of the image forming region on the recording medium 22 which is disposed on the outer circumferential surface of the print drum 70. The ink heads 72C, 72M, 72Y and 72K are inkjet recording heads (inkjet heads) of a full line type, which each have, formed in the ink ejection surface thereof, nozzle rows in which a plurality of nozzles for ejecting ink are arranged through the fall width of the image forming region. The ink heads 72C, 72M, 72Y and 72K are fixed so as to extend in the direction perpendicular to the direction of conveyance of the recording medium 22 (the direction of rotation of the print drum 70).

These ink heads 72C, 72M, 72Y and 72K respectively eject liquid droplets of corresponding colored inks onto the recording surface of the recording medium 22 which is held on the outer circumferential surface of the print drum 70. In so doing, the coloring material (pigment) dispersed in the ink is caused to aggregate by the treatment liquid which has previously been deposited on the recording surface of the recording medium 22 by the treatment liquid deposition unit 12, thereby forming an aggregate of the coloring material in such a manner that a flow of coloring material, or the like, does not occur on the recording medium 22. In this way, an image is formed on the recording medium.

One conceivable example of a reaction between the ink and the treatment liquid uses a mechanism whereby the dispersion of the pigment is broken down and the pigment is caused to aggregate by a reduction in the pH resulting from the introduction of an acid into the treatment liquid, thereby preventing bleeding of the coloring material, color mixing between inks of the respective colors, and droplet ejection interference caused by combination of the liquid of the ink droplets upon landing on the medium.

Furthermore, the droplet ejection timing of the respective ink heads 72C, 72M, 72Y and 72K is synchronized with an encoder 91 (see FIG. 11) which is disposed on the print drum 70 and determines the speed of rotation. In this way, it is possible to determine the landing positions with good accuracy. Furthermore, speed variations caused by fluctuations in the print drum 70, or the like, are identified in advance, the droplet ejection timing obtained by the encoder 91 is corrected accordingly, and therefore non-uniformities in droplet ejection can be reduced, independently of fluctuations in the print drum 70, the accuracy of the rotational axle, or the speed of the outer circumferential surface of the print drum 70.

Moreover, a maintenance operation is carried out by withdrawing the head unit from the print drum 70, and cleaning the nozzle surfaces of the ink heads 72C, 72M, 72Y and 72K, expelling ink of increased viscosity, and so on.

Furthermore, although a configuration with the four standard colors of C, M, Y and K is described in the present embodiment, the combinations of the ink colors and the number of colors are not limited to those. Light and/or dark inks, and special color inks can be added as required. For example, a configuration is possible in which ink heads for ejecting light-colored inks, such as light cyan and light magenta, are added, and there is no particular restriction on the arrangement sequence of the heads of the respective colors. A more detailed description of the ink heads 72C, 72M, 72Y and 72K is given below.

The treatment liquid drum 54 of the treatment liquid deposition unit 12 and the print drum 70 of the print unit 14 are formed as separate structures, and therefore treatment liquid does not become attached to the ink heads 72C, 72M, 72Y and 72K, and it is possible to reduce the causes of ink ejection failures.

Drying Unit

Figure 5:
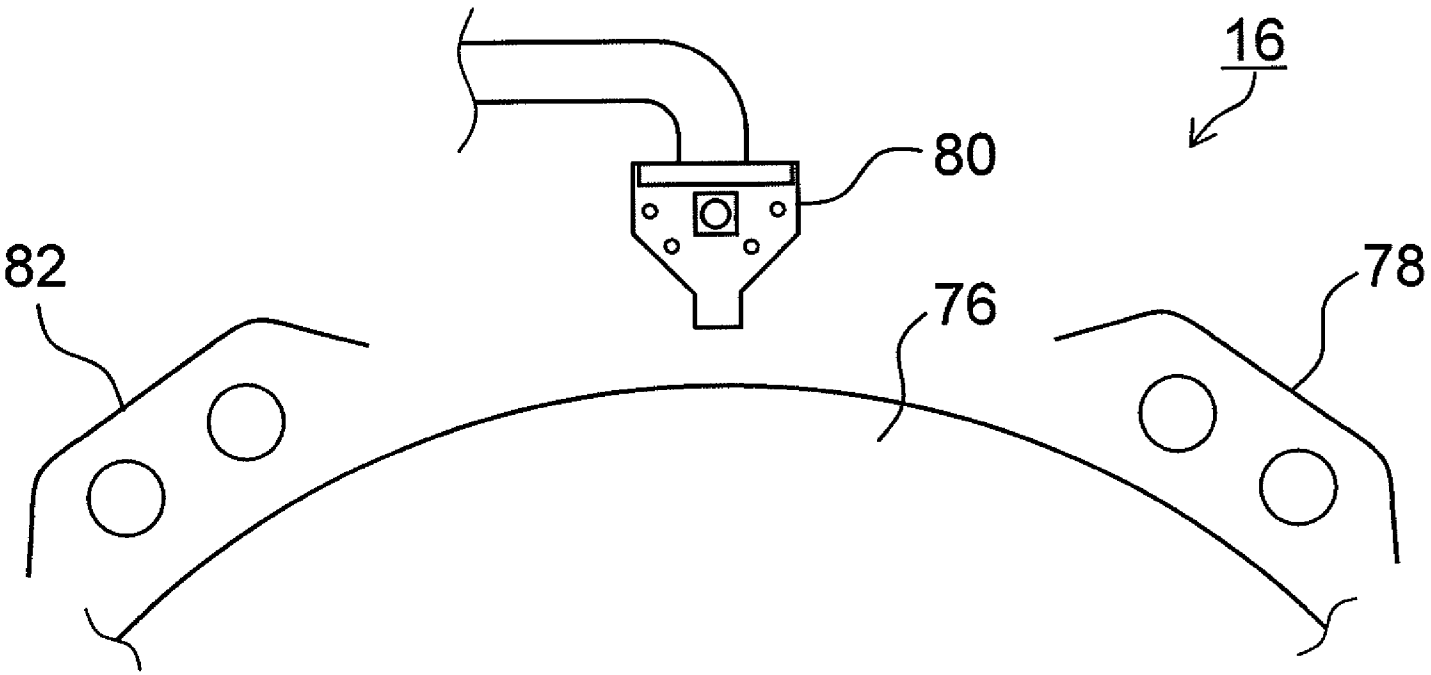
FIG. 5 is a diagram of the arrangement of a drying drum, a first infrared heater, a hot air blowing nozzle and a second infrared heater in a drying unit.

As illustrated in FIG. 1 above, the drying unit 16 comprises a drying drum 76, and as illustrated in FIG. 5, the drying unit 16 comprises a first infrared heater 78, a hot air blowing nozzle 80, and a second infrared heater 82 disposed in positions opposing the circumferential surface of the drying drum 76, in this order from the upstream side in terms of the direction of rotation of the drying drum 76 (the counter-clockwise direction in FIG. 1).

The drying unit 76 is a drum which holds and conveys in rotation a recording medium 22 on the outer circumferential surface thereof. The first infrared heater 78, the hot air blowing nozzle 80 and the second infrared heater 82 are drying devices for drying the moisture contained in the ink solvent which has been deposited on the recording medium 22.

The drying unit 16 performs a step of drying the moisture contained in the solvent which is separated by the aggregating action of the coloring material, by evaporating off the moisture contained in the ink solvent on the recording surface of the recording medium 22 held on the drying drum 76, by means of the first infrared heater 78, the hot air blowing nozzle 80 and the second infrared heater 82 illustrated in FIG. 5.

The drying drum 76 holds the leading edge of the recording medium 22 by means of a hook-shaped holding device (a device similar to the holding device 73 in FIG. 4) which is provided on the outer circumferential side of the drum. The drying drum 76 may also have suction holes provided in the outer circumferential side thereof, in order to hold the recording medium 22 in close contact by suctioning via the suction holes.

The temperature of the hot air emitted from the hot air blowing nozzle 80 is 50° C. to 70° C., and the evaporated moisture is expelled to the exterior of the apparatus together with the air, by an exhaust device which is not illustrated. It is also possible to cool the recovered air by means of a cooler (radiator), or the like, and to recover the moisture as a liquid.

For example, the temperature of the drying drum 76 is set to 60° C. or lower, the temperature of the first infrared heater 78 and the second infrared heater 82 is set to 180° C., the temperature of the hot air from the hot air blowing nozzle 80 is set to 70° C., and the flow rate of the hot air from the hot air blowing nozzle 80 is set to 12 $m^3$/minute.

The print drum 70 of the print unit 14 and the drying drum 76 of the drying unit 16 are formed by separate structures, and therefore it is possible to reduce the occurrence of ink ejection failures in the ink heads 72C, 72M, 72Y and 72K due to drying of the head maintenance unit by heat drying. Furthermore, the temperature of the drying unit 16 can be set freely and therefore an optimal drying temperature can be set.

Fixing Unit

Figure 6:
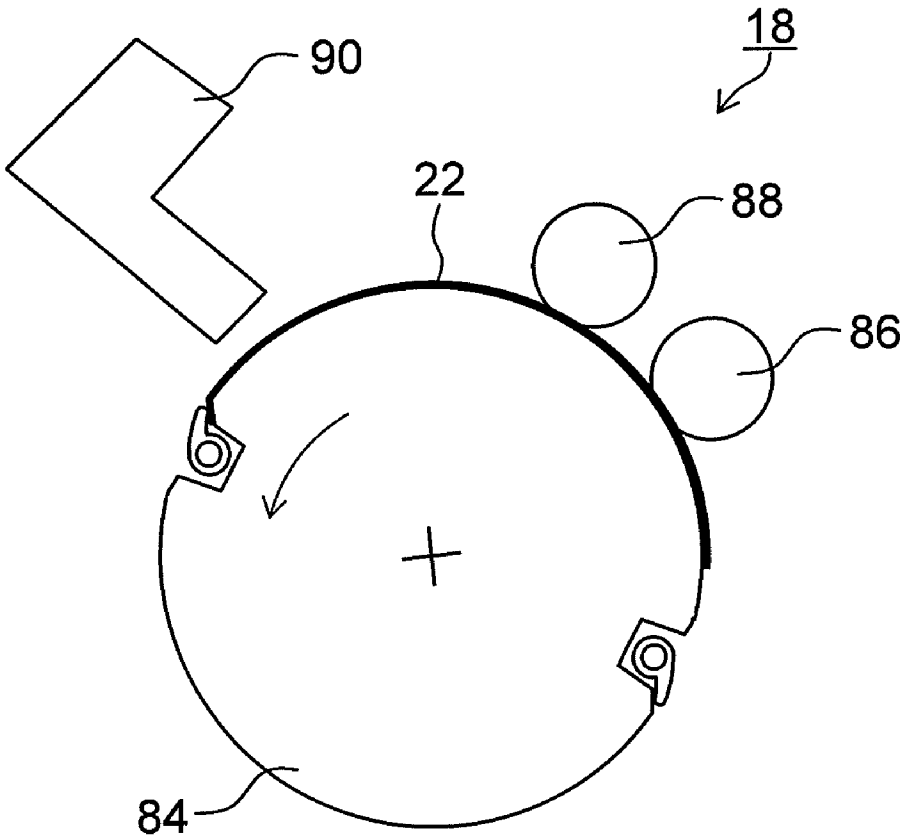
FIG. 6 is a diagram of the arrangement of a fixing drum, a first fixing roller, a second fixing roller and an in-line sensor in a fixing unit.

As illustrated in FIG. 1 above, the fixing unit 18 comprises a fixing drum 84, and as illustrated in FIG. 6, the fixing unit 18 comprises a first fixing roller 86, a second fixing roller 88 and an in-line sensor 90, disposed in positions opposing the circumferential surface of the fixing drum 84, in this order from the upstream side in terms of the direction of rotation of the fixing drum 84 (the counter-clockwise direction in FIG. 6).

The fixing unit 84 is a drum which holds and conveys in rotation a recording medium 22 on the outer circumferential surface thereof. The first fixing roller 86 and the second fixing roller 88 are roller members for fixing the image formed on the recording medium 22. The in-line sensor 90 is a measurement device for measuring a test pattern, the amount of moisture, the surface temperature, the luster, and the like, of the image fixed on the recording medium 22, and uses a CCD line sensor, or the like.

The fixing drum 84 holds the leading edge of the recording medium 22 by means of a hook-shaped holding device (a device similar to the holding device 73 in FIG. 4) which is provided on the outer circumferential side of the drum. The fixing drum 84 may also have suction holes provided on the outer circumferential side thereof, similarly to the suction holes 74 of the print drum 70 described above, in such a manner that the recording medium 22 is held in close contact with the drum by suctioning via the suction holes.

In the fixing unit 18, as illustrated in FIG. 6, the latex particles inside the thin image layer formed by the drying unit 16 on the recording surface of the recording medium 22 which is held on the fixing drum 84 are heated and pressurized by the first fixing roller 86 and the second fixing roller 88 and caused to melt, thereby fixing same to the recording medium 22.

The first fixing roller 86 and the second fixing roller 88 are heated rollers which incorporate a halogen lamp inside a metal pipe of aluminum, or the like, which has good thermal conductivity. By applying thermal energy equal to or greater than the Tg temperature (glass transition temperature) of the latex so as to melt the latex particles, the latex is pressed into the undulations in the recording medium 22 and fixed therein, and furthermore, the surface undulations of the image are leveled and a high luster can be obtained.

Furthermore, the first fixing roller 86 and the second fixing roller 88 form nip roller pairs with the fixing roller 84, and at least one of the pair of rollers has an elastic layer on the surface of the roller and thereby forms a uniform nip with respect to the recording medium 22.

Moreover, the first fixing roller 86 and the second fixing roller 88 may also be provided in a plurality of stages, depending on the thickness of the image layer and the Tg characteristics of the latex particles.

The temperature of the fixing drum 84 is set to 60° C., for example, the temperature of the first fixing roller 86 and the second fixing roller 88 is set to 60 to 80° C., and the nip pressure of the first fixing roller 86 and the second fixing roller 88 is set to 1 MPa.

Since the processes constituted by the fixing unit 18 and the other drums are separated in structural terms, then the temperature setting of the fixing unit 18 can be set freely and independently of the print unit 14 or the drying unit 16.

Output Unit

The output unit 20 is provided after the fixing unit 18. A transfer drum 94, a conveyance belt 96 and a tensioning roller 98 are provided between the fixing drum 84 of the fixing unit 18 and the output tray 92 of the output unit 20, so as to oppose same. The recording medium 22 is sent to the conveyance belt 96 by the transfer drum 94 and then output to the output tray 92.

Structure of the Ink Head

Next, the structure of an ink head will be described. The ink heads 72C, 72M, 72Y and 72K of the respective ink colors have the same structure, and a reference numeral 100 is hereinafter designated to any of the ink heads.

Figure 7A:
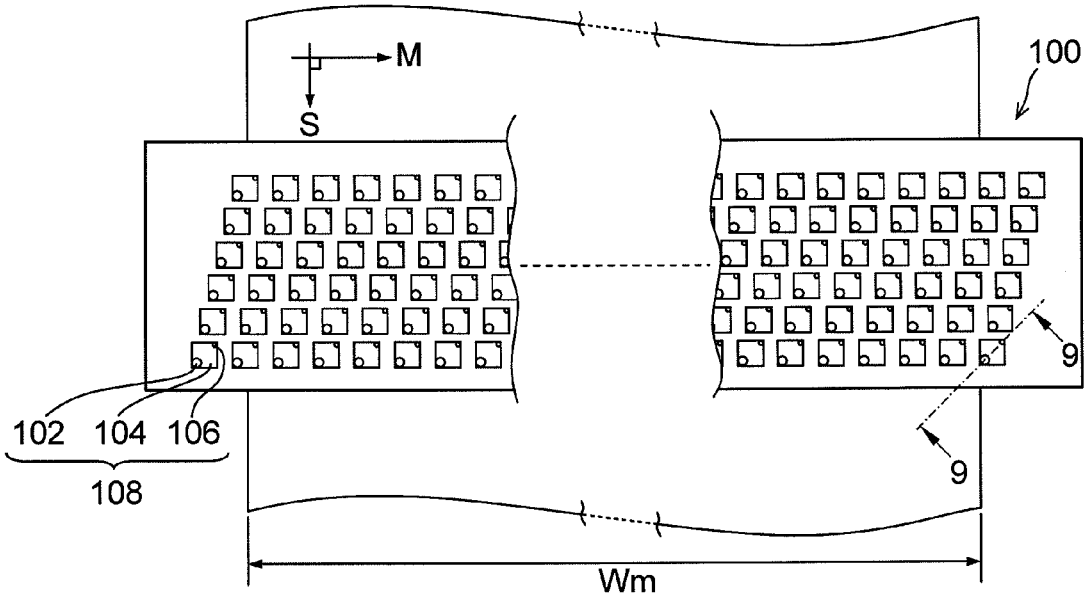
FIGS. 7A and 7B are plan view perspective diagrams illustrating the internal structure of a head.
Figure 7B:
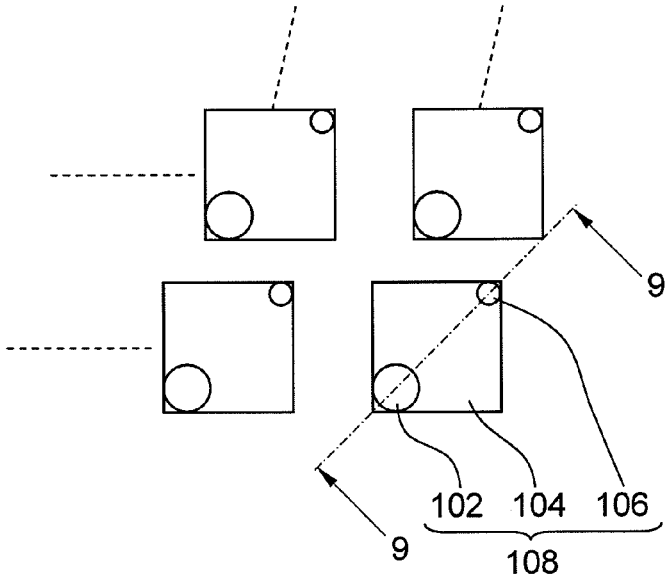

FIG. 7A is a perspective plan view illustrating an example of the configuration of the ink head 100, FIG. 7B is an enlarged view of a portion thereof. The nozzle pitch in the ink head 100 should be minimized in order to maximize the density of the dots printed on the surface of the recording medium 22. As illustrated in FIGS. 7A and 7B, the ink head 100 according to the present embodiment has a structure in which a plurality of ink chamber units (droplet ejection elements as recording element units) 108, each comprising a nozzle 102 forming an ink ejection port, a pressure chamber 104 corresponding to the nozzle 102, and the like, are disposed two-dimensionally in the form of a staggered matrix, and hence the effective nozzle interval (the projected nozzle pitch) as projected in the lengthwise direction of the head (the direction perpendicular to the conveyance direction of the recording medium 22) is reduced and high nozzle density is achieved.

Figure 8:
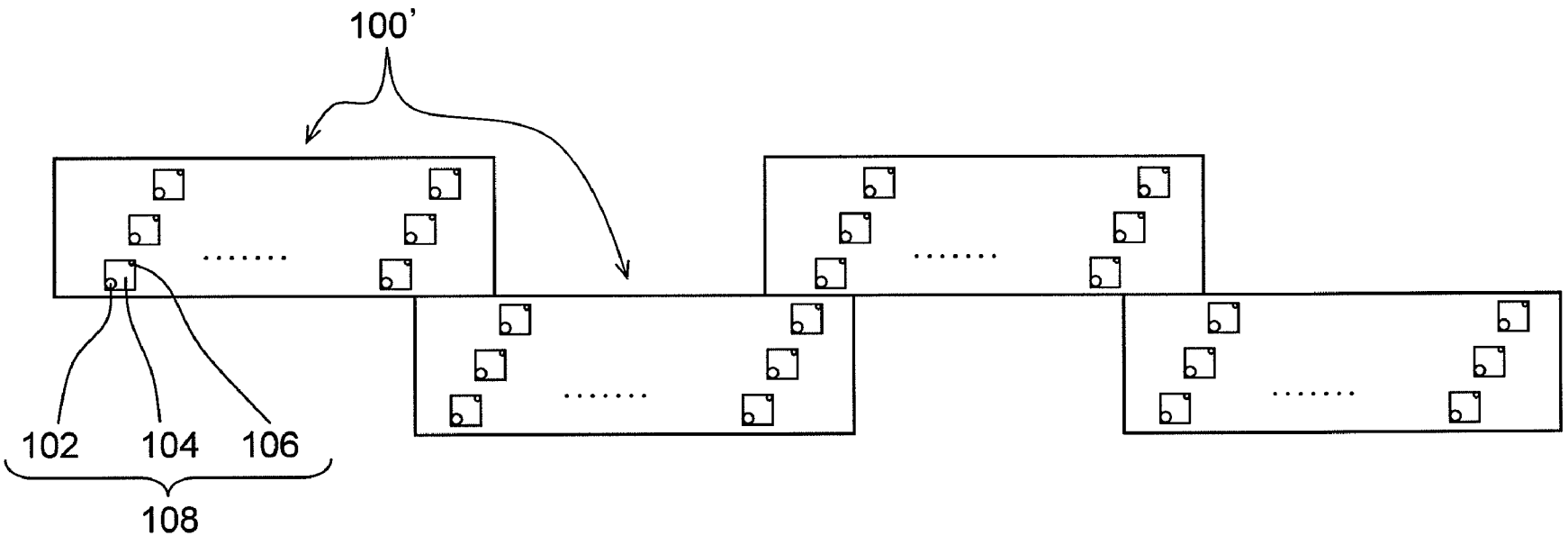
FIG. 8 is a plan diagram illustrating a further example of the composition of a head.

The mode of composing one or more nozzle rows through a length corresponding to the full width of the image forming region of the recording medium 22 in the direction substantially perpendicular to conveyance direction of the recording medium 22 (arrow S in FIG. 7A), (in other words, in the direction indicated by arrow M in FIG. 7A), is not limited to the example illustrated in FIGS. 7A and 7B. For example, instead of the composition in FIG. 7A, as illustrated in FIG. 8, a line head having nozzle rows of a length corresponding to the entire width of the image forming region of the recording medium 22 can be formed by arranging and combining, in a staggered matrix, short head modules 100' each having a plurality of nozzles 102 arrayed in a two-dimensional fashion.

As illustrated in FIGS. 7A and 7B, the planar shape of the pressure chamber 104 provided corresponding to each nozzle 102 is substantially a square shape, and an outlet port to the nozzle 102 is provided at one of the ends of a diagonal line of the planar shape, while an inlet port (supply port) 106 for supplying ink is provided at the other end thereof. The shape of the pressure chamber 104 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

Figure 9:
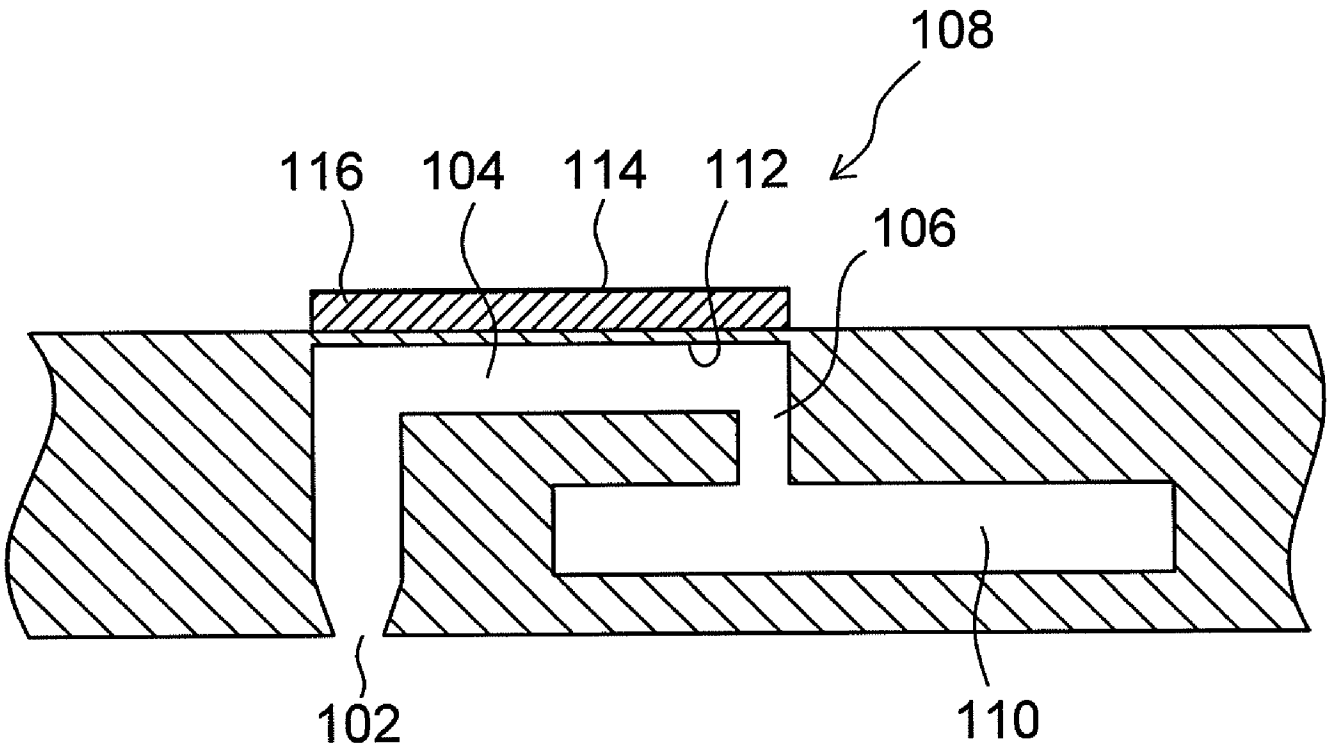
FIG. 9 is a cross-sectional view along line 9-9 in FIGS. 7A and 7B.

FIG. 9 is a cross-sectional diagram (along line 9-9 in FIGS. 7A and 7B) illustrating the composition of the liquid droplet ejection element of one channel which forms a recording element unit in the ink head 100 (an ink chamber unit corresponding to one nozzle 102).

As illustrated in FIG. 9, each pressure chamber 104 is connected to a common channel 110 through the supply port 106. The common channel 110 is connected to an ink tank (not illustrated), which is a base tank that supplies ink, and the ink supplied from the ink tank is supplied, through the common flow channel 110, to the pressure chambers 104.

An actuator 116 provided with an individual electrode 114 is bonded to a pressure plate (a diaphragm that also serves as a common electrode) 112 which forms the surface of one portion (in FIG. 9, the ceiling) of the pressure chambers 104. When a drive voltage is applied to the individual electrode 114 and the common electrode, the actuator 116 deforms, thereby changing the volume of the pressure chamber 104. This causes a pressure change which results in ink being ejected from the nozzle 102. For the actuator 116, it is possible to adopt a piezoelectric element using a piezoelectric body, such as lead zirconate titanate, barium titanate, or the like. When the displacement of the actuator 116 returns to its original position after ejecting ink, the pressure chamber 104 is replenished with new ink from the common flow channel 110, via the supply port 106.

By controlling the driving of the actuators 116 corresponding to the nozzles 102 in accordance with the dot data generated from the input image by a digital half-toning process, it is possible to eject ink droplets from the nozzles 102. By controlling the ink ejection timing of the nozzles 102 in accordance with the speed of conveyance of the recording medium 22, while conveying the recording medium 22 in the sub-scanning direction at a uniform speed, it is possible to record a desired image on the recording medium 22.

Figure 10:
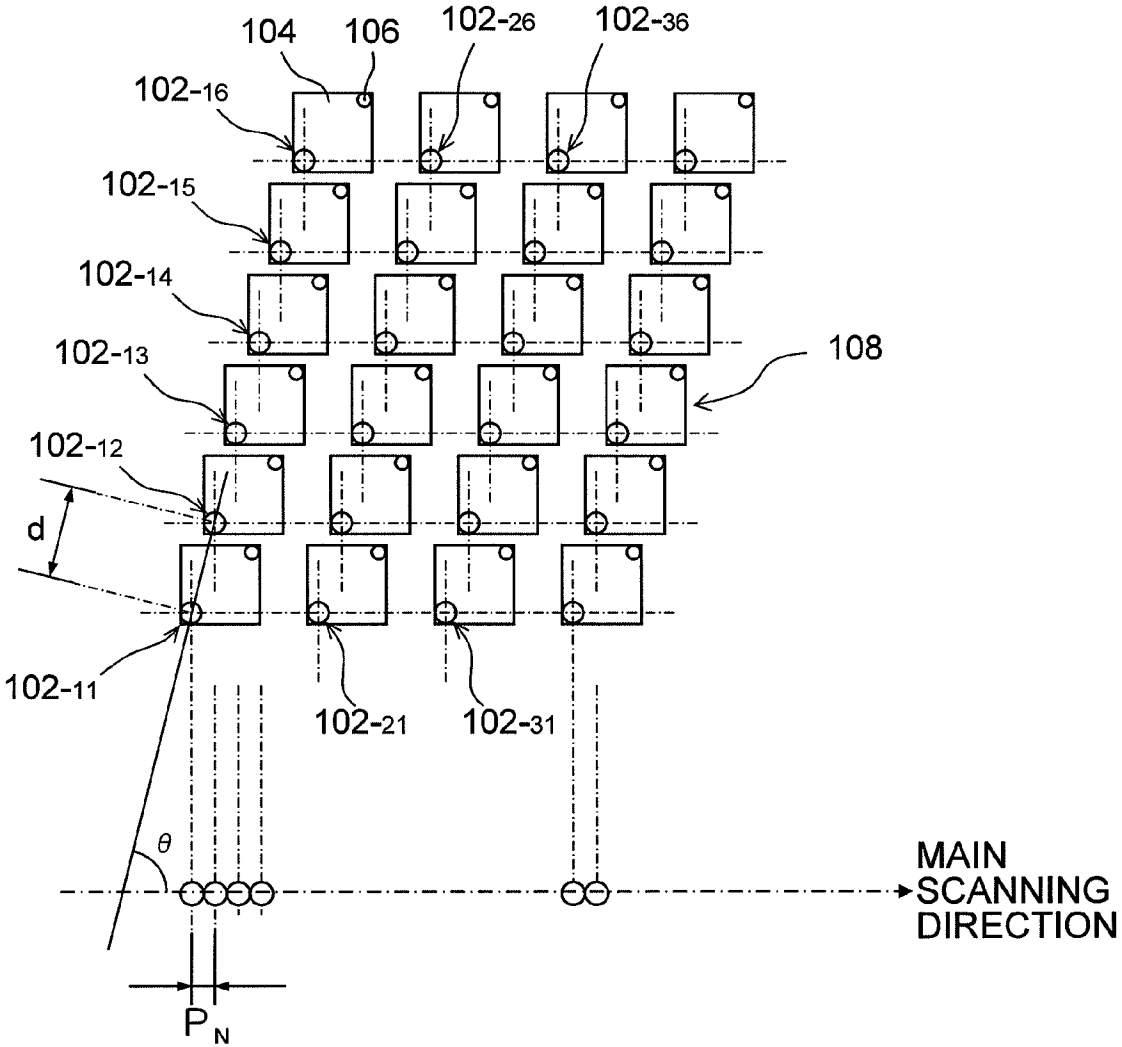
FIG. 10 is a plan diagram illustrating an example of the arrangement of nozzles in a head.

As illustrated in FIG. 10, the high-density nozzle head according to the present embodiment is achieved by arranging a plurality of ink chamber units 108 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 108 are arranged at a uniform pitch d in line with a direction forming an angle of θ with respect to the main scanning direction, the pitch $P_N$ of the nozzles projected (orthogonal projection) so as to align in the main scanning direction is d×cos θ, and hence the nozzles 102 can be regarded to be equivalent to those arranged linearly at a fixed pitch $P_N$ along the main scanning direction. By adopting a composition of this kind, it is possible to achieve higher density of the effective nozzles rows when the nozzles are projected to an alignment in the main scanning direction.

In a full-line head comprising rows of nozzles that have a length corresponding to the entire width of the image recordable width, the "main scanning" is defined as printing one line (a line formed of a row of dots, or a line formed of a plurality of rows of dots) in the direction perpendicular to the conveyance direction of the recording medium 22 by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 102 arranged in a matrix such as that illustrated in FIG. 10 are driven, the main scanning according to the above-described (3) is preferred. More specifically, the nozzles 102-11, 102-12, 102-13, 102-14, 102-15 and 102-16 are treated as a block (additionally; the nozzles 102-21, 102-22, . . . , 102-26 are treated as another block; the nozzles 102-31, 102-32, . . . , 102-36 are treated as another block; . . . ); and one line is printed in the direction perpendicular to the conveyance direction of the recording medium 22 by sequentially driving the nozzles 102-11, 102-12, . . . , 102-16 in accordance with the conveyance velocity of the recording medium 22.

On the other hand, "sub-scanning" is defined as to repeatedly perform printing of one line (a line formed of a row of dots, or a line formed of a plurality of rows of dots) formed by the main scanning, while moving the fall-line head and the recording medium 22 relatively to each other.

The direction indicated by one line (or the lengthwise direction of a band-shaped region) recorded by the main scanning as described above is called the "main scanning direction", and the direction in which the sub-scanning is performed, is called the "sub-scanning direction". In other words, in the present embodiment, the conveyance direction of the recording medium 22 is called the sub-scanning direction and the direction perpendicular to same is called the main scanning direction. In implementing the present embodiment of the invention, the arrangement of the nozzles is not limited to that of the example illustrated.

Moreover, a method is employed in the present embodiment where an ink droplet is ejected by means of the deformation of the actuator 116, which is typically a piezoelectric element; however, in implementing the present embodiment of the invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Control System

Figure 11:
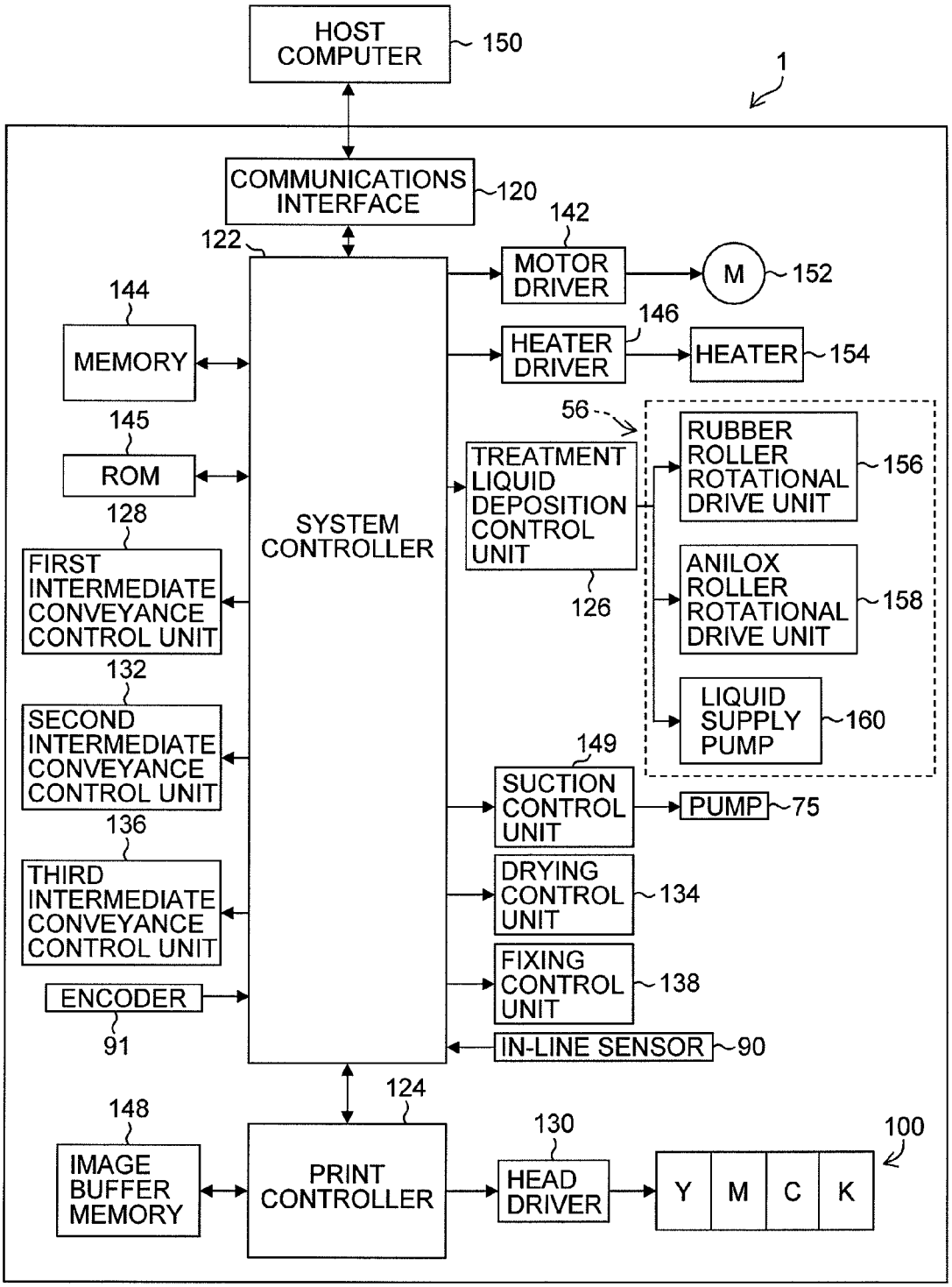
FIG. 11 is a principal block diagram illustrating the system composition of an inkjet recording apparatus.

FIG. 11 is a principal block diagram illustrating the system composition of the inkjet recording apparatus 1. The inkjet recording apparatus 1 comprises a communications interface 120, a system controller 122, a print controller 124, a treatment liquid deposition control unit 126, a first intermediate conveyance control unit 128, a head driver 130, a second intermediate conveyance control unit 132, a drying control unit 134, a third intermediate conveyance control unit 136, a fixing control unit 138, an in-line sensor 90, an encoder 91, a motor driver 142, a memory 144, a heater driver 146, an image buffer memory 148, a suction control unit 149, and the like.

The communications interface 120 is an interface unit for receiving image data sent from a host computer 150. A serial interface such as USB (Universal Serial Bus), IEEE1394, Ethernet (registered trademark), wireless network, or a parallel interface such as a Centronics interface may be used as the communications interface 120. A buffer memory (not illustrated) may be mounted in this portion in order to increase the communication speed. The image data sent from the host computer 150 is received by the inkjet recording apparatus 1 through the communications interface 120, and is temporarily stored in the memory 144.

The system controller 122 is constituted by a central processing unit (CPU) and peripheral circuits thereof, and the like, and functions as a control apparatus which controls the whole of the inkjet recording apparatus 1 in accordance with prescribed programs, as well as functioning as a calculation apparatus which carries out various calculations. In other words, the system controller 122 controls the respective sections such as the communications interface 120, the treatment liquid deposition control unit 126, the first intermediate conveyance control unit 128, the head driver 130, the second intermediate conveyance control unit 132, the drying control unit 134, the third intermediate conveyance control unit 136, the fixing control unit 138, the memory 144, the motor driver 142, the heater driver 146, the suction control unit 149, and the like, and controls communications with the host computer 150 and reading from and writing to the memory 144, and the like, as well as generating control signals for controlling the motor 152 of the conveyance system and the heater 154.

The memory 144 is a storage device which temporarily stores an image input via the communications interface 120, and data is read from and written to the image memory 144 via the system controller 122. The memory 144 is not limited to being a memory comprising a semiconductor element, and may also use a magnetic medium, such as a hard disk.

Programs executed by the CPU of the system controller 122 and the various types of data which are required for control procedures are stored in the ROM 145. The ROM 145 may be a non-writeable storage device, or it may be a rewriteable storage device, such as an EEPROM. The memory 144 is used as a temporary storage region for the image data, and it is also used as a program development region and a calculation work region for the CPU.

The motor driver 142 is a driver which drives the motor 152 in accordance with instructions from the system controller 122. In FIG. 11, the motors disposed in the respective sections in the apparatus are represented by the reference numeral 152. For example, the motor 152 illustrated in FIG. 11 includes motors that drive the rotation of the transfer drum 52, the treatment liquid drum 54, the print drum 70, the drying drum 76, the fixing drum 84, the transfer drum 94, and the like in FIG. 1, the drive motor of the pump 75 for creating a negative pressure suction via the suction holes 74 of the print drum 70, the motor of the withdrawal mechanism of the head unit of the ink heads 72C, 72M, 72Y, 72K, and so on.

The heater driver 146 is a driver which drives the heater 154 in accordance with instructions from the system controller 122. In FIG. 11, the plurality of heaters which are provided in the inkjet recording apparatus 1 are represented by the reference numeral 154. For example, the heater 154 illustrated in FIG. 11 includes a pre-heater (not illustrated) which heats the recording medium 22 previously to a suitable temperature in the paper supply unit 10.

The print controller 124 has a signal processing function for performing various tasks, compensations, and other types of processing for generating print control signals from the image data stored in the memory 144 in accordance with commands from the system controller 122 so as to supply the generated print data (dot data) to the head driver 130. Required signal processing is carried out in the print controller 124, and the ejection amount and the ejection timing of the ink droplets from the respective ink heads 100 are controlled via the head driver 130, on the basis of the print data. In this way, desired dot size and dot positions can be achieved.

The print controller 124 is provided with the image buffer memory 148; and image data, parameters, and other data are temporarily stored in the image buffer memory 148 when image data is processed in the print controller 124. The aspect illustrated in FIG. 11 is one in which the image buffer memory 148 accompanies the print controller 124; however, the memory 144 may also serve as the image buffer memory 148. Also possible is an aspect in which the print controller 124 and the system controller 122 are integrated to form a single processor.

To give a general description of the sequence of processing from image input to print output, image data to be printed (original image data) is input from an external source via the communications interface 120, and is accumulated in the memory 144. At this stage, RGB image data is stored in the memory 144, for example.

In this inkjet recording apparatus 1, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible. Therefore, original image data (RGB data) stored in the memory 144 is sent to the print controller 124 through the system controller 122, and is converted to the dot data for each ink color by a half-toning technique, using a threshold value matrix, error diffusion, or the like, in the print controller 124.

In other words, the print controller 124 performs processing for converting the input RGB image data into dot data for the four colors of K, C, M and Y. The dot data generated by the print controller 124 in this way is stored in the image buffer memory 148.

The head driver 130 outputs drive signals for driving the actuators 116 corresponding to the respective nozzles 102 of the ink heads 100, on the basis of the print data supplied by the print controller 124 (in other words, the dot data stored in the image buffer memory 148). A feedback control system for maintaining constant drive conditions in the head may be included in the head driver 130.

By supplying the drive signals output by the head driver 130 to the ink heads 100, ink is ejected from the corresponding nozzles 102. An image is formed on the recording medium 22 by controlling ink ejection from the ink heads 100 while conveying the recording medium 22 at a prescribed speed.

Furthermore the system controller 122 controls the treatment liquid deposition control unit 126, the first intermediate conveyance control unit 128, the second intermediate conveyance control unit 132, the drying control unit 134, the third intermediate conveyance control unit 136, the fixing control unit 138 and the suction control unit 149.

The treatment liquid deposition control unit 126 controls the operation of the treatment liquid application apparatus 56 of the treatment liquid deposition unit 12, in accordance with instructions from the system controller 122. More specifically, in the treatment liquid application apparatus 56, a rubber roller rotation drive unit 156 which drives the rotation of the rubber roller 62, an anilox roller rotation drive unit 158 which drives the rotation of the anilox roller 64, and a liquid supply pump 160 which supplies treatment liquid to the treatment liquid container 68, and the like, are controlled by the treatment liquid deposition control unit 126.

The first intermediate conveyance control unit 128 controls the operation of the intermediate conveyance body 30 and the conveyance guide 32 of the first intermediate conveyance unit 24, in accordance with instructions from the system controller 122. More specifically, in the intermediate conveyance body 30, it controls the actual rotational driving of the intermediate conveyance body 30, the rotation of the holding device 34 provided on the intermediate conveyance body 30, and the driving of the blower 38, and the like. Furthermore, in the conveyance guide 32, it controls the operation of the pump 43 which performs a suctioning operation via the suction holes 42, and the like.

Figure 12:
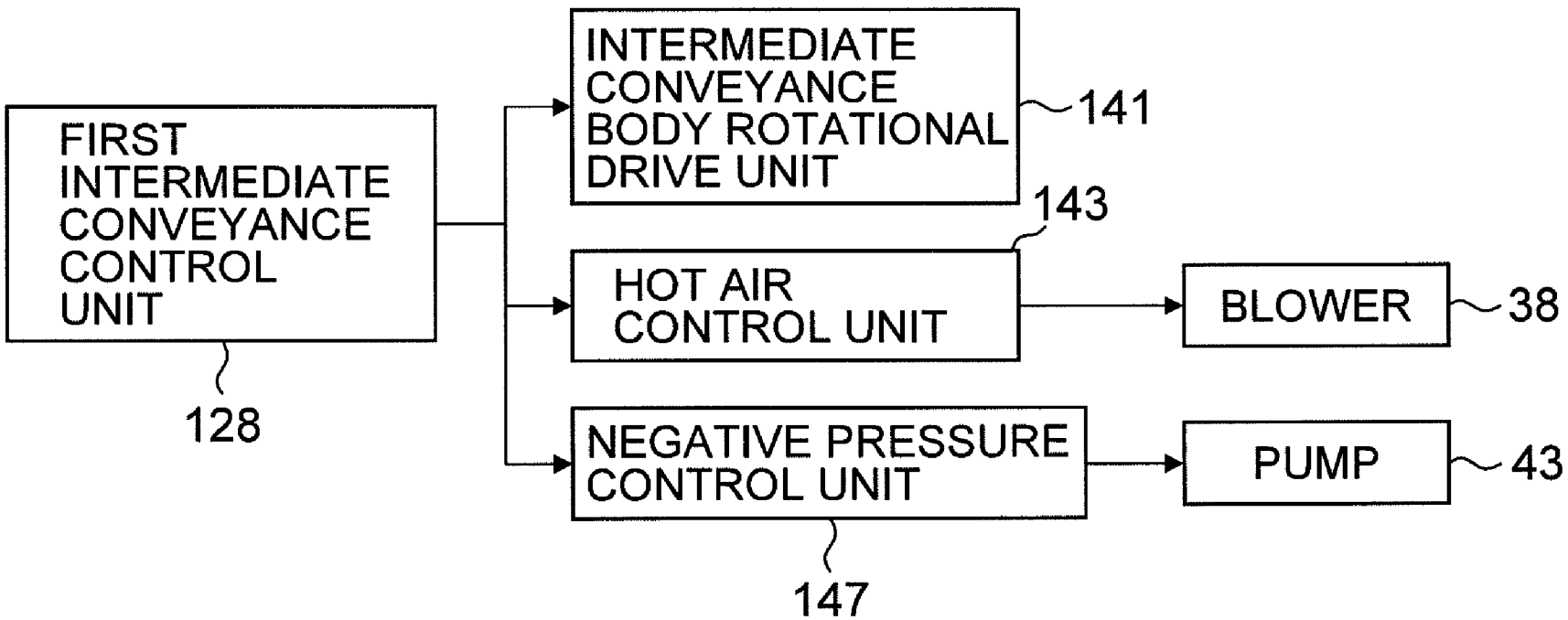
FIG. 12 is a principal block diagram illustrating the system composition of a first intermediate conveyance control unit.

FIG. 12 is a principal block diagram illustrating the system composition of the first intermediate conveyance control unit 128. As illustrated in FIG. 12, the first intermediate conveyance control unit 128 comprises an intermediate conveyance body rotational drive unit 141, an air blowing control unit 143, and a negative pressure control unit 147.

The rotational driving of the actual intermediate conveyance body 30 is controlled by the intermediate conveyance body rotational drive unit 141.

The air blowing control unit 143 is able to control and adjust the temperature and flow rate of the wind blown from the blower 38, so as to promote the efficient drying of the moisture contained in the treatment liquid, reduction of the viscosity of the high-boiling-point solvent, and permeation of the solvent. Furthermore, it is also possible to control the flow rate of the air blown from the blower 38 and to control the magnitude of the positive pressure created by the blown air, in accordance with the type of recording medium 22. Furthermore, it is also possible to control the temperature of the air blown from the blower 38 in accordance with the type of recording medium 22 (such as high-quality paper, coated paper, and the like).

The pump 43 is controlled by the negative pressure control unit 147 to suction the recording medium 22 via the non-recording surface, which is the surface opposite to the recording surface, in such a manner that the solvent contained in the treatment liquid permeates through the recording medium. Furthermore, it is also possible to control the negative pressure applied by the pump 43 in such a manner that the pressure can be altered on the basis of at least one of the thickness of the recording medium 22 and the void ratio of the recording medium 22. Furthermore, it is also possible to control the magnitude of the negative pressure applied by the pump 43 in accordance with the type of recording medium 22.

The second intermediate conveyance control unit 132 and the third intermediate conveyance control unit 136 have a similar system structure to the first intermediate conveyance control unit 128, and respectively control the operations of the intermediate conveyance bodies 30 and conveyance guides 32 of the second intermediate conveyance unit 26 and the third intermediate conveyance unit 28.

The drying control unit 134 controls the operations of the first infrared heater 78, the hot air blowing nozzle 80 and the second infrared heater 82 in the drying unit 16, in accordance with instructions from the system controller 122.

The fixing control unit 138 controls the operations of the first fixing roller 86 and the second fixing roller 88 in the fixing unit 18 in accordance with instructions from the system controller 122.

The suction control unit 149 controls the operation of the pump 75 which is connected to the suction holes 74 of the print drum 70 in the print unit 14.

Furthermore, a test pattern applied to the recording medium 22, and a determination signal of measurement results data for the moisture content, surface temperature and luster, and other characteristics, of the recording medium 22, are also input to the system controller 122 from the in-line sensor 90. Moreover, a determination signal for the speed of rotation of the print drum 70 is input from the encoder 91 and the droplet ejection timing of the ink head 100 is duly controlled via the head driver 130.

Intermediate Conveyance Unit

Next, the structure of the intermediate conveyance units will be described.

The first intermediate conveyance unit 24 is a conveyance device for conveying the recording medium 22 from the treatment liquid drum 54 of the treatment liquid deposition unit 12 to the print drum 70 of the print unit 14. The second intermediate conveyance unit 26 is a conveyance device for conveying the recording medium 22 from the print drum 70 of the print unit 14 to the drying drum 76 of the drying unit 16. The third intermediate conveyance unit 28 is a conveyance device for conveying the recording medium 22 from the drying drum 76 of the drying unit 16 to the fixing drum 84 of the fixing unit 18.

The first intermediate conveyance unit 24, the second intermediate conveyance unit 26 and the third intermediate conveyance unit 28 share a similar structure, and therefore the first intermediate conveyance unit 24 is described here as a representative example.

As illustrated in FIG. 1, the first intermediate conveyance unit 24 is a conveyance device for conveying a recording medium 22 from the treatment liquid drum 54 of the treatment liquid deposition unit 12 to the print drum 70 of the print unit 14. In broad terms, the first intermediate conveyance unit 24 is composed of an intermediate conveyance body 30 and a conveyance guide 32.

The intermediate conveyance body 30 is a device which holds an edge of the recording medium 22 that has been received from the treatment liquid drum 54, which is the pressure drum of the treatment liquid deposition unit 12, and causes the recording medium 22 to rotate and be transferred to the print drum 70. As illustrated in FIG. 4, the intermediate conveyance body 30 has a hook-shaped holding device 34 for holding an edge of the recording medium 22. The holding device 34 rotates while tracing a circular path. In the present embodiment, two holding devices 34 are provided on the respective end portions of the intermediate conveyance body 30, but the number of holding devices 34 is not limited to this.

Figure 13A:
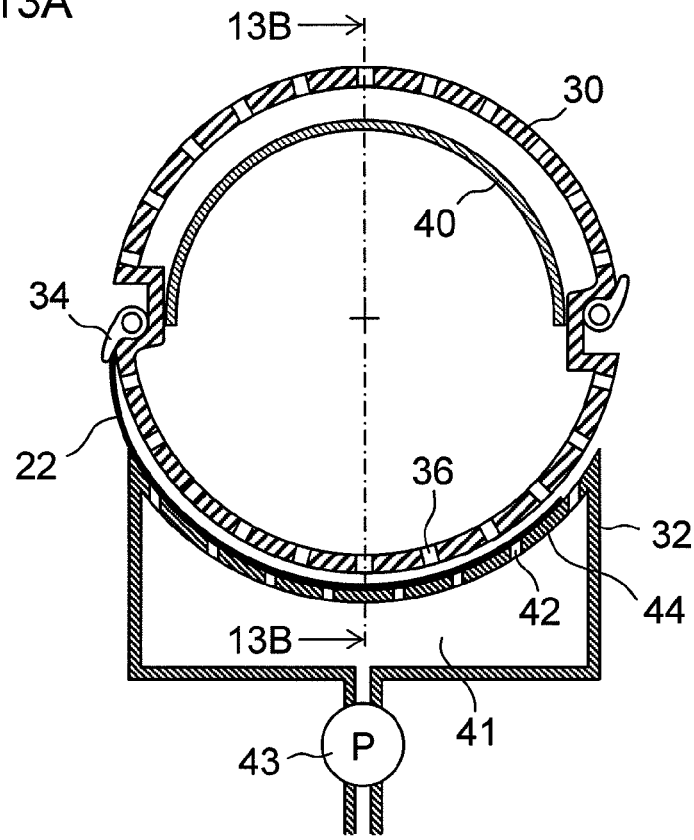
FIGS. 13A and 13B are cross-sectional diagrams of a first intermediate conveyance unit (in particular.
Figure 13B:
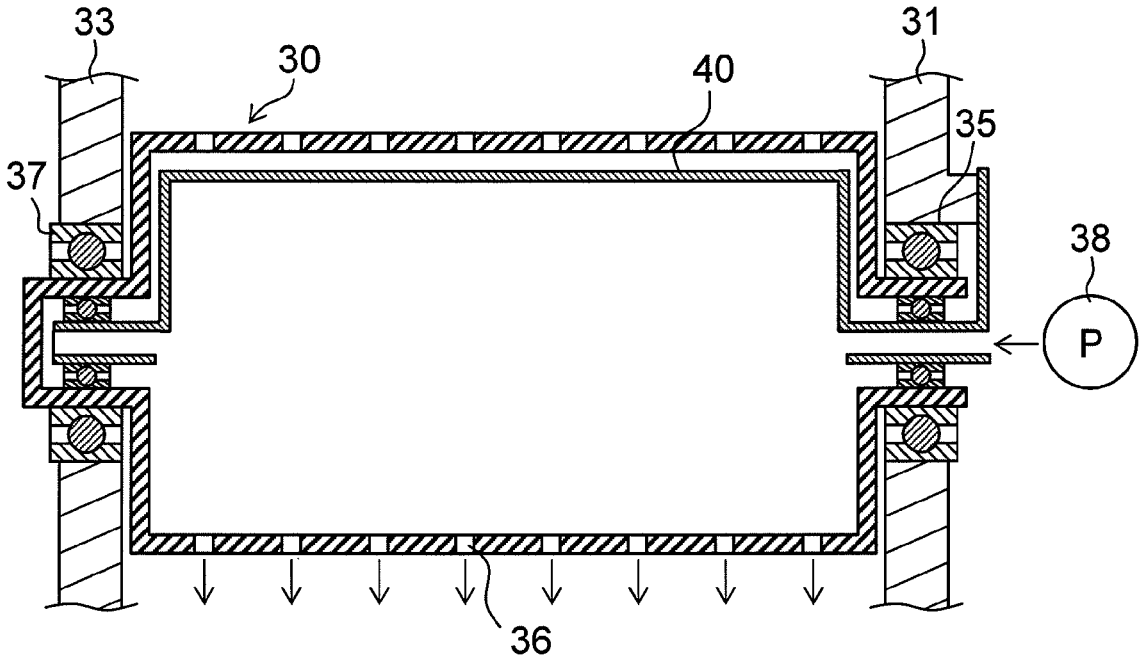

FIGS. 13A and 13B are cross-sectional diagrams of the first intermediate conveyance unit, and FIG. 13B is a cross-sectional view along line 13B-13B in FIG. 13A.

As illustrated in FIG. 13B, the intermediate conveyance body 30 is provided rotatably via bearings 35, 37 on frames 31 and 33 which are fixed at an interval apart in the breadthways direction of the conveyed recording medium 22 (the direction perpendicular to the direction of conveyance).

As illustrated in FIGS. 13A and 13B, a plurality of air blowing apertures 36 for blowing an air flow onto the recording surface of the recording medium 22 are formed in the surface of the intermediate conveyance body 30. The air blowing apertures 36 are connected to the blower 38 which forms an air blowing device for blowing a flow of air. The air flow which is blown from the blower 38 is set, for example, to a temperature of 70° C. and a flow volume of 1 $m^3$/minute. Furthermore, desirably, an air flow is blown in a virtually perpendicular fashion onto the recording surface of the recording medium 22, from the plurality of air blowing apertures 36.

Since the recording medium 22 is moved in rotation following the conveyance guide 32 due to the hot air blown from the air blowing apertures 36, then the contact between the intermediate conveyance body 30 and the recording surface of the recording medium 22 is avoided and adherence of treatment liquid to the intermediate conveyance body 30 can be prevented.

Furthermore, as illustrated in FIGS. 13A and 13B, the intermediate conveyance body 30 internally comprises an air flow restriction guide 40 which partially restricts the air flow which is blown out from the air blowing apertures 36. The air flow restriction guide 40 is fixed to the frame 31, as illustrated in FIG. 13B. For example, in FIG. 13A, the recording medium 22 is held by the holding device 34 on the left-hand side of the drawing, and a state is depicted in which the recording medium 22 is positioned toward the conveyance guide 32 side with respect to the intermediate conveyance body 30. In this case, the air flow restricting guide 40 restricts the direction of the air flow in such a manner that an air flow is blown out from the air blowing apertures 36 which oppose the recording surface of the recording medium 22.

By restricting the direction of the air flow by means of the air flow restricting guide 40, the recording medium 22 is moved in rotation following the conveyance guide 32 more reliably due to the air flow blown from the air blowing apertures 36, and therefore the contact between the intermediate conveyance body 30 and the recording surface of the recording medium 22 is avoided more reliably and adherence of treatment liquid to the intermediate conveyance body 30 can be prevented.

Moreover, the air blowing apertures 36 and the blower 38, and the like, are positive pressure application devices which apply a positive pressure by blowing an air flow onto the recording surface of the recording medium 22, and they also serve a function as a back-tension application device which cause a force to act on the recording medium 22 in the direction opposite to the direction of rotation, and therefore the recording medium 22 is moved in rotation while a back tension is caused to act on the recording surface of the recording medium 22.

In this way, when the recording medium 22 is conveyed in close contact with the print drum 70 by means of the leading edge of the recording medium 22 being held by the holding device 73 of the print drum 70, a back tension acts on the recording surface of the trailing edge of the recording medium 22 due to the air flow emitted from the air blowing apertures 36, and therefore wrinkling and curling of the recording medium 22 do not occur during its conveyance to the print drum 70.

Furthermore, as illustrated in FIG. 4, the conveyance guide 32 is disposed in the vicinity of the intermediate conveyance body 30. The conveyance guide 32 is formed in a circular arc shape and guides the rotational movement of the recording medium 22 while applying a back tension to the surface of the recording medium 22 opposite to the recording surface (below, this is referred to as the "non-recording surface"). More specifically, the conveyance guide 32 comprises a guide surface 30*a* for guiding the conveyance of the recording medium 22, which is provided opposing the position where the holding devices 34 of the intermediate conveyance body 30 trace a circular arc-shaped path, and comprises a back tension application device which causes a force to act on the recording medium 22 in the direction opposite to the direction of rotation of the recording medium 22.

For the back tension application device, it is possible to use a negative pressure application device which applies a negative pressure to the non-recording surface of the recording medium 22. More specifically, as the negative pressure application device, there are provided: a plurality of suction holes 42 which are formed in the guide surface 30*a*, a chamber 41 which is connected to the suction holes 42, a pump 43 which is connected to the chamber 41, and so on.

Furthermore, the guide surface 30*a* comprises a plurality of supporting sections 44 which support and guide the recording medium 22.

In this way, when the recording medium 22 is conveyed in close contact with the print drum 70 by means of the leading edge of the recording medium 22 being held by the holding device 73 of the print drum 70, a back tension acts on the non-recording surface of the trailing edge of the recording medium 22 due to the suctioning via the suction holes 42, and therefore wrinkling and curling of the recording medium 22 do not occur during its conveyance to the print drum 70.

By means of the intermediate conveyance body 30 and the conveyance guide 32 which have the composition described above, the recording medium 22 is rotated and moved by means of the leading edge thereof being held by the holding device 34 of the intermediate conveyance body 30, while the non-recording surface is suctioned with a negative pressure by the pump 43, via the suction holes 42 in the guide surface 30*a* of the conveyance guide 32. Consequently, the recording medium 22 is moved in rotation while being supported and guided by the holding sections 44. Thereafter, the recording medium 22 is transferred to the holding device 73 of the print drum 70 from the holding device 34 of the intermediate conveyance body 30.

Here, the recording medium 22 is conveyed while the non-recording surface is supported by the supporting sections 44, and the recording surface of the recording medium 22 is conveyed without making contact with the constituent members of the intermediate conveyance body 30 or the conveyance guide 32 or the like. Consequently, the treatment liquid layer formed by the treatment liquid deposited on the recording surface of the recording medium 22 by the treatment liquid deposition unit 12 remains in position without the occurrence of any treatment liquid non-uniformities or treatment liquid defects, or the like.

Furthermore, when the recording medium 22 is conveyed in close contact with the print drum 70 by means of the leading edge of the recording medium 22 being held by the holding device 73 of the print drum 70, then a back tension acts on the recording surface and the non-recording surface of the trailing edge of the recording medium 22, no wrinkling or curling of the recording medium 22 conveyed to the print drum 70 occurs, and an image of high quality can be formed.

Apart from this, the back tension application device may also be constituted by supporting sections 44 which have a large coefficient of friction on the surface thereof. More specifically, such a device may be constituted by supporting sections 44 having an increased surface roughness or supporting sections 44 having a surface made of a material such as rubber. In this way, it is possible to achieve similar beneficial effects to a case where suction is applied.

As described above, a possible case is one in which the treatment liquid deposition unit 12 is provided with an intermediate conveyance unit instead of the transfer drum 52, the intermediate conveyance body 30 of the intermediate conveyance unit holds the leading edge of the recording medium 22 and moves the recording medium 22 in rotation, and the recording medium 22 is thereby transferred onto the treatment liquid drum 54; in this case also, the intermediate conveyance unit also has a common structure to that of the first intermediate conveyance unit 24, the second intermediate conveyance unit 26 and the third intermediate conveyance unit 28.

In this way, when the recording medium 22 is conveyed in close contact with the treatment liquid drum 54 by means of the leading edge of the recording medium 22 being held by the holding device of the treatment liquid drum 54, a back tension acts between the leading edge of the recording medium 22 and the portion conveyed in close contact with the drum, and hence there is no occurrence of wrinkling or curling when the recording medium 22 is conveyed to the treatment liquid drum 54 and a beneficial effect is achieved in that a uniform thickness of the applied film of treatment liquid is obtained.

Figure 14:
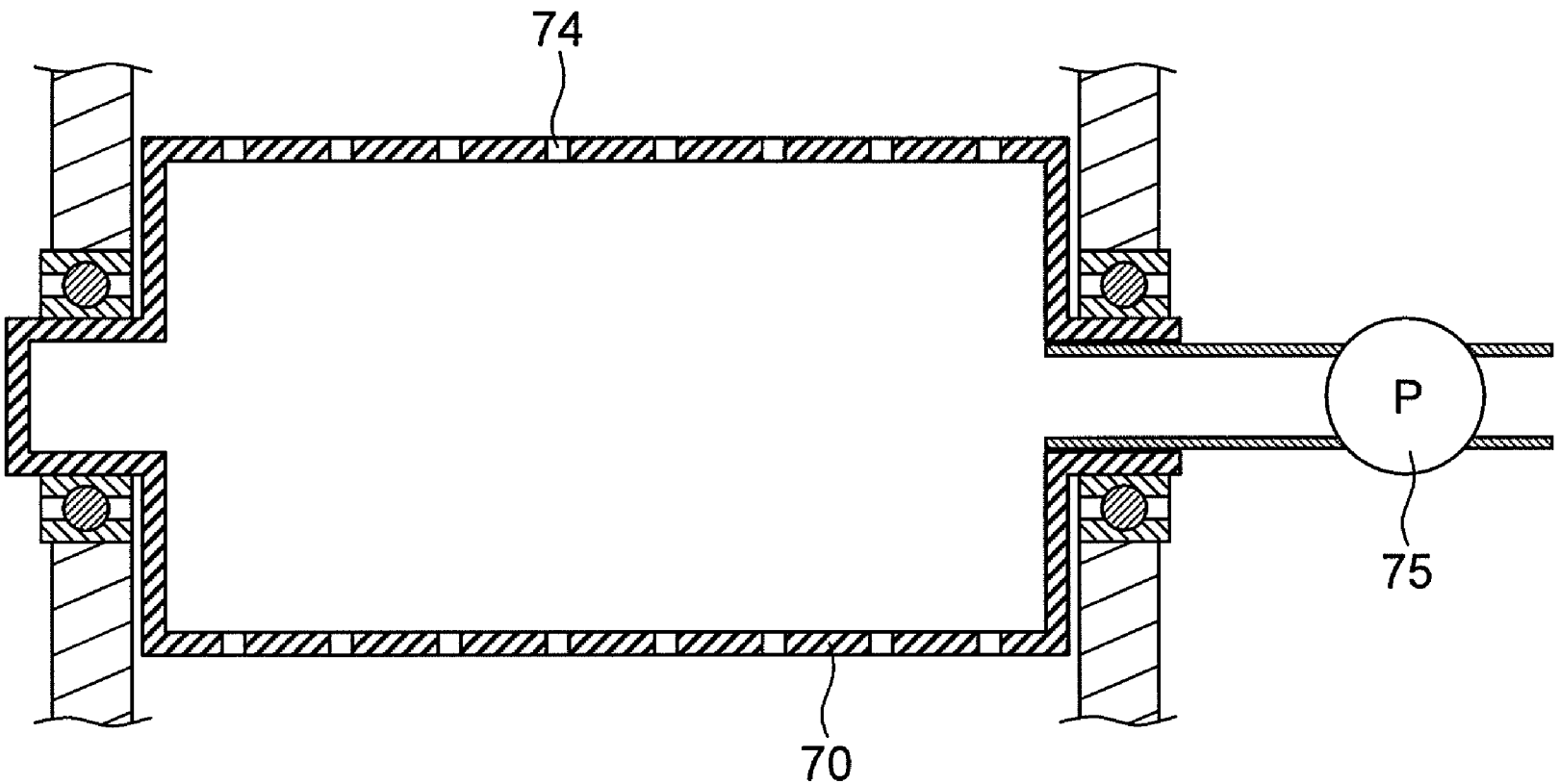
FIG. 14 is a cross-sectional diagram of a print drum.

FIG. 14 is a cross-sectional diagram of the vicinity of the print drum 70 when viewed in the breadthways direction of the recording medium 22 (the direction perpendicular to the direction of conveyance of the recording medium 22). As illustrated in FIG. 14, suction holes 74 for suctioning a negative pressure which are connected to the pump 75 are provided in the outer circumferential side of the print drum 70. Accordingly, when the recording medium 22 is conveyed in close contact with the print drum 70, the leading edge of the recording medium 22 is suctioned to make close contact with the print drum 70, while a back tension is caused to act on the trailing edge of the recording medium 22 by the first intermediate conveyance unit 24, and therefore it is possible to prevent the occurrence of wrinkling or curling of the recording medium 22 on the print drum 70 in a more reliable fashion. It is also possible to keep the leading edge of the recording medium 22 in close contact with the print drum 70 by means of electrostatic attraction.

Beneficial Effects of First Embodiment

Since the conveyance guide 32 causes a force (back tension) to act on the recording medium in the direction opposite to the direction of rotation of the recording medium 22, when the recording medium 22 is transferred onto the print drum 70, the drying drum 76 and the fixing drum 84, then the occurrence of wrinkling and curling of the recording medium 22 when it is conveyed to the print drum 70, the drying drum 76 and the fixing drum 84 can be reduced, and furthermore, on the drying drum, the application of a tension to the medium promotes drying and therefore curling and cockling of the paper is reduced, while on the fixing drum, the application of a tension to the medium reduces curling of the paper while it is conveyed to the fixing unit, and therefore a beneficial effect in preventing the occurrence of wrinkling in the fixing unit is obtained.

Furthermore, as a device for applying a back tension, it is possible to employ a device which applies a pressure to the recording medium 22.

The device for applying a pressure to the recording medium 22 may be a device which suctions the non-recording surface of the recording medium 22. If the magnitude of the negative pressure applied to the non-recording surface of the recording medium 22 is controlled by the negative pressure control unit 147 in accordance with the type of recording medium 22, then it is possible to achieve compatibility with the general properties of the recording medium 22.

Moreover, the device for applying a pressure to the recording medium 22 may be a device which blows an air flow onto the recording surface of the recording medium 22. By partially restricting the air flow which is blown onto the recording surface of the recording medium 22, for example, by restricting the direction of the air flow by means of the air flow restricting guide 40 in such a manner that an air flow is blown out from the air blowing apertures 36 in a direction which opposes the recording surface of the recording medium 22, it is possible to cause a back tension to act on the recording medium 22 in an efficient manner. Furthermore, by controlling the magnitude of the positive pressure by controlling the flow rate of the air flow by means of the air flow control unit 143 in accordance with the type of recording medium 22, it is possible to achieve compatibility with the general properties of the recording medium 22.

Moreover, by providing a device which causes the recording medium 22 to make close contact with the circumferential surface of the drum, on the print drum 70, the drying drum 76 and the fixing drum 84, the occurrence of wrinkling and curling of the medium is prevented reliably when the recording medium 22 is conveyed to the print drum 70. Possible examples of a device for causing the recording medium 22 to make close contact with the circumferential surface of the drum include a suction device, an electrostatic attraction device, or the like.

Other Beneficial Effects

Since the conveyance guide 32 applies at least one of a negative pressure and/or a positive pressure to the recording medium 22 which is moved in rotation by the intermediate conveyance body 30, then it is possible to promote the permeation of the high-boiling-point solvent of the treatment liquid and the ink into the recording surface of the recording medium 22. The high-boiling-point solvent is a non-aqueous solvent (a solvent which is other than water) having a boiling point of 100° C. or above. Similar beneficial effects are obtained in cases where the treatment liquid contains a non-aqueous solvent other than a high-boiling-point solvent.

Here, Table 1 illustrates the evaluation results of the viscosity characteristics of a high-boiling-point solvent with respect to the temperature of the liquid, in the case of a liquid which contains a high-boiling-point solvent. Table 1 illustrates the evaluation results obtained when the content ratio of the high-boiling-point solvent was set to five different values and the temperature of the liquid was set to three different values. The unit of viscosity was mPa·s (cP).

TABLE 1

| | | Content of high-boiling-point solvent wt %: Weight percent | | | | |
|---|---|---|---|---|---|---|
| | | 100 wt % | 90 wt % | 67 wt % | 50 wt % | 33 wt % |
| Temperature of liquid | 25° C. | 507 mPa · s | 264 mPa · s | 33.9 mPa · s | 10.85 mPa · s | 4.146 mPa · s |
| | 40° C. | 246 mPa · s | 101.8 mPa · s | 16.14 mPa · s | 5.196 mPa · s | 2.58 mPa · s |
| | 60° C. | 82.44 mPa · s | 33.72 mPa · s | 7.308 mPa · s | 3.204 mPa · s | 1.56 mPa · s |

As illustrated in Table 1, the viscosity of the high-boiling-point solvent tends to become lower, the higher the temperature of the liquid, and therefore it is possible to promote permeation into the recording medium 22 by raising the temperature of the treatment liquid and ink through blowing hot air via the air blowing apertures 36 and thus reducing the viscosity of the high-boiling-point solvent in the treatment liquid or ink.

Furthermore, by controlling the temperature of the air flow which is blown from the air blowing apertures 36 by means of the air blowing control unit 143, in accordance with the amount of high-boiling-point solvent that has been deposited on the recording surface of the recording medium 22, in the first intermediate conveyance unit 24, the second intermediate conveyance unit 26 and the third intermediate conveyance unit 28, the viscosity of the high-boiling solvent is lowered, thus promoting its permeation into the recording medium 22, and when the high-boiling-point solvent on the recording medium has permeated into the recording medium and the aggregated coloring material is subsequently fixed on the recording medium, a beneficial effect is obtained in that the fixing strength and the offset with respect to the fixing roller are improved.

Modification Example

Figure 15:
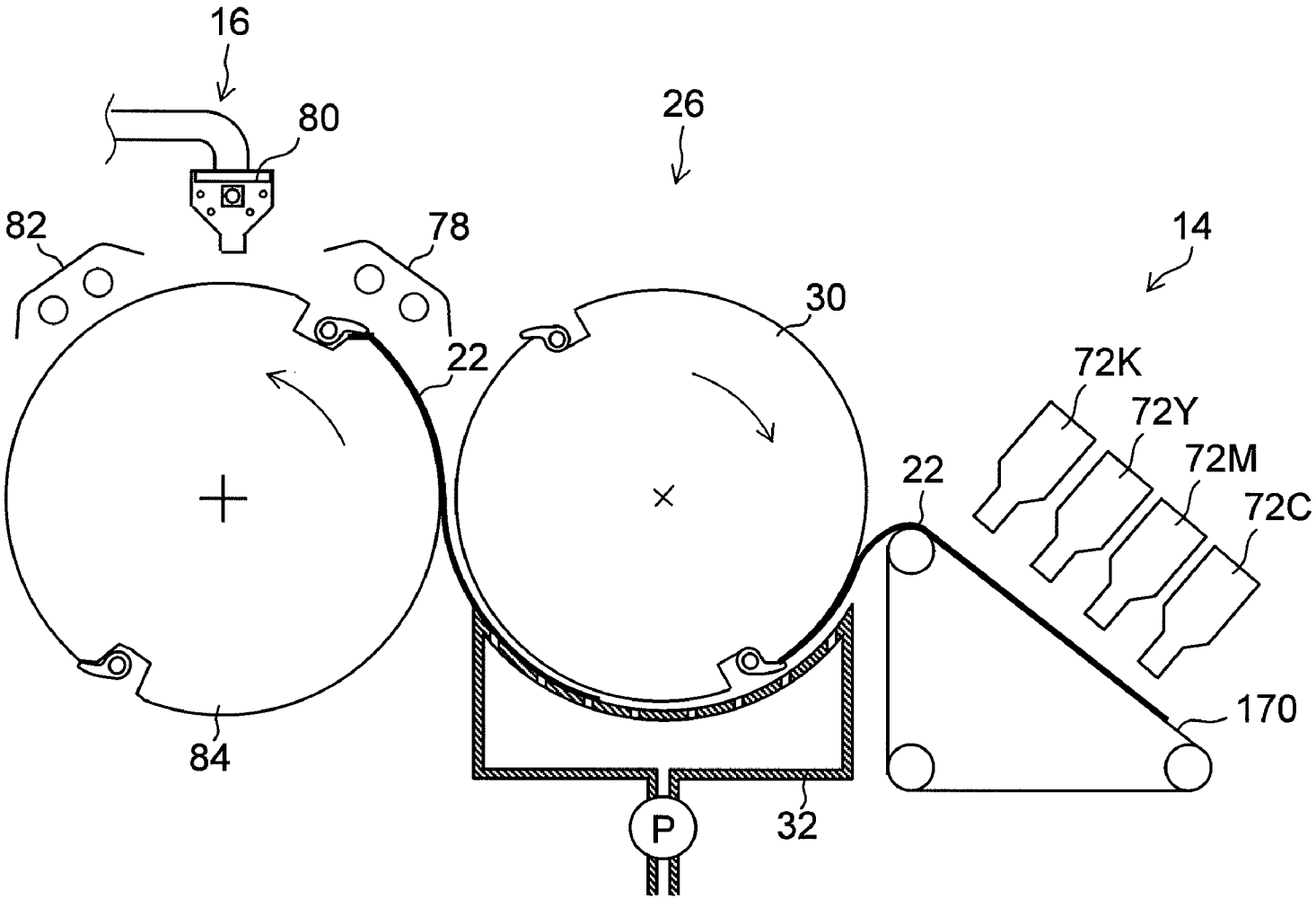
FIG. 15 is a diagram illustrating an example where a conveyance belt is used instead of a print drum.

As a modification example of the first embodiment, in the inkjet recording apparatus 1 according to the first embodiment, it is possible to change the conveyance device on the side which transfers to the intermediate transfer body 30, to a belt device. FIG. 15 is a diagram which illustrates an example where a conveyance belt 170 is used instead of the print drum 70 in the print unit 14 of the inkjet recording apparatus 1. In the conveyance belt 170 illustrated in FIG. 15, a recording medium 22 is conveyed by suction. In a modification example of this kind, it is also possible to obtain similar beneficial effects to those of the inkjet recording apparatus 1 described above.

Second Embodiment

As a second embodiment of the invention, an inkjet recording apparatus 2 which uses special paper as a recording medium 22 will be described. The special paper is a paper which has previously undergone a treatment which promotes the aggregation of the coloring material (pigment) and latex particles contained in the deposited ink so as to separate the coloring material and the solvent of the ink.

Figure 16:
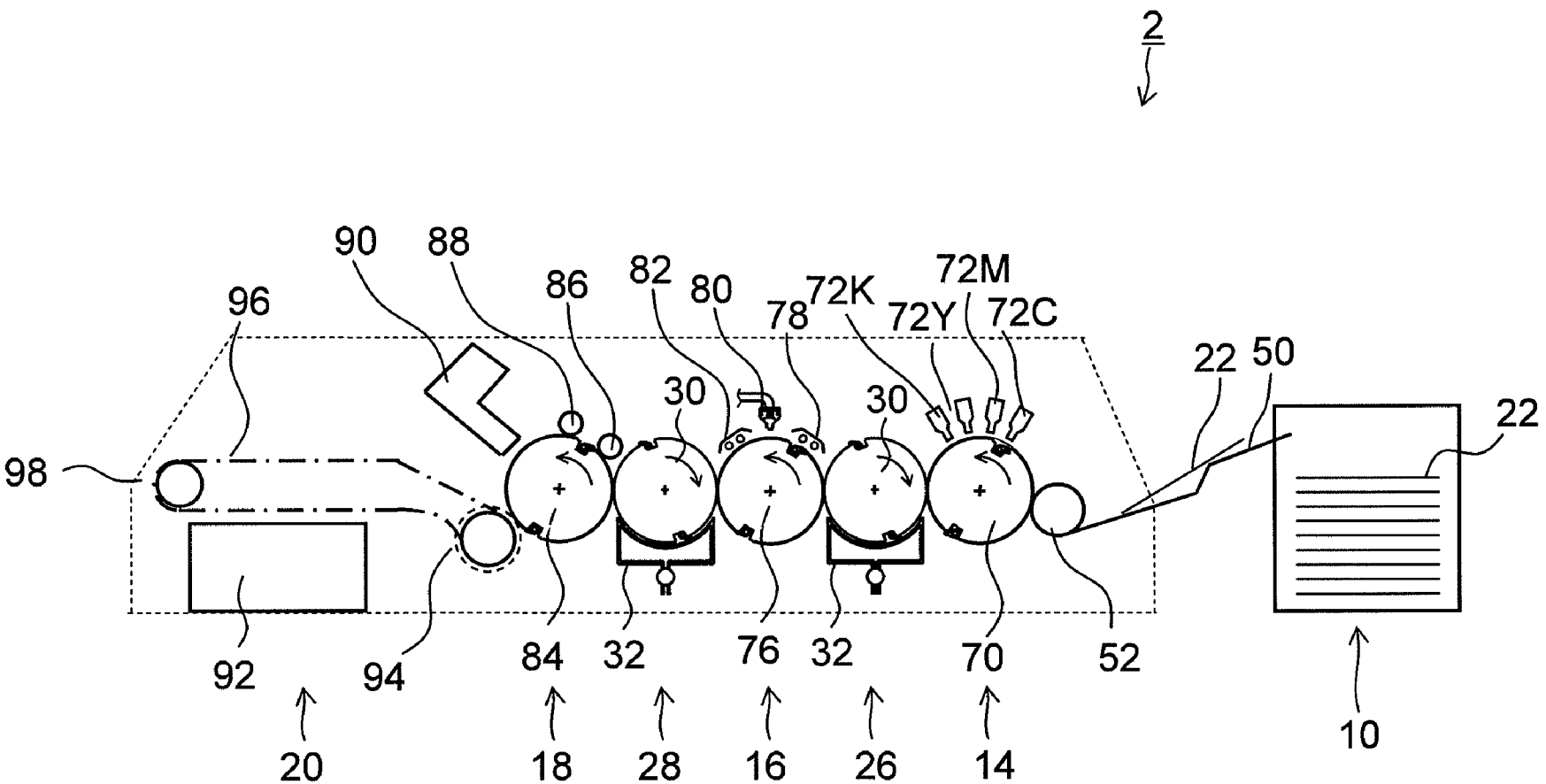
FIG. 16 is a general schematic drawing of an inkjet recording apparatus according to a second embodiment of the invention.

The inkjet recording apparatus 2 according to the second embodiment differs from the inkjet recording apparatus 1 according to the first embodiment in that it does not comprise the treatment liquid deposition unit 12 and the first intermediate conveyance unit 24. FIG. 16 illustrates a general schematic drawing of the inkjet recording apparatus 2 according to the second embodiment. The remainder of the composition is the same as that of the inkjet recording apparatus 1 according to the first embodiment.

In the inkjet recording apparatus 2 according to the second embodiment, in the second intermediate conveyance unit 26, the special paper is moved in rotation by means of the leading edge of the special paper being held by the holding device 34 of the intermediate conveyance body 30. In this case, by performing at least either one of blowing an air flow from air blowing apertures 36 in the intermediate conveyance body 30 and suctioning via suction holes 42 in the conveyance guide 32, the non-recording surface of the special paper is conveyed while being supported by the supporting sections 44. Therefore, the special paper is conveyed without the recording surface thereof making contact with the intermediate conveyance body 30. Consequently, the image formed by the ink deposited on the recording surface of the special paper by the print unit 14 is maintained in an unaltered state.

Furthermore, when the leading edge of the special paper is held by the holding device of the fixing drum 84 and the special paper is conveyed in close contact with the fixing drum 84, a back tension acts on at least one of the recording surface and the non-recording surface of the trailing edge of the special paper. Consequently, when the special paper is conveyed in close contact with the fixing drum 84, wrinkling and curling of special paper do not occur and deformation of the special paper is suppressed.

One conceivable method of causing a back tension to act on the recording surface of the trailing edge of the special paper is to blow an air flow from air blowing apertures 36 in the intermediate conveyance body 30. Furthermore, one conceivable method of causing a back tension to act on the non-recording surface of the trailing edge of the special paper is to perform suctioning via suctioning holes 42 in the conveyance guide 32, or to increase the surface roughness of the supporting sections 44 of the conveyance guide 32 or to increase the frictional force thereof by attaching rubber, or the like.

By partially restricting the air flow which is blown onto the recording surface of the recording medium 22, for example, by restricting the direction of the air flow by means of the air flow restricting guide 40 in such a manner that an air flow is blown out from the air blowing apertures 36 in a direction which opposes the recording surface of the recording medium 22, it is possible to cause a back tension to act on the recording medium 22 in an efficient manner.

Moreover, by providing a device which causes the recording medium 22 to make close contact with the circumferential surface of the drum, on the print drum 70, the drying drum 76 and the fixing drum 84, the occurrence of wrinkling and curling of the medium is prevented reliably when the recording medium 22 is conveyed to the print drum 70. Possible examples of a device for causing the recording medium 22 to make close contact with the circumferential surface of the drum include a suction device, an electrostatic attraction device, or the like.

Moreover, in the second intermediate conveyance unit 26 and the third intermediate conveyance unit 28, by carrying out at least one of suctioning via suction holes 42 in the conveyance guide 32 and blowing an air flow from air blowing apertures 36 in the intermediate conveyance body 30, the high-boiling-point solvent contained in the ink that has been deposited in the print unit 14 is caused to permeate into the special paper. Consequently, when the image is fixed by fixing rollers 86 and 88 in the fixing unit 18 provided in a subsequent stage, since no high-boiling-point solvent is present on the surface of the recording medium 22, it is possible to ensure adhesiveness between the aggregated coloring material and the recording surface, thereby improving the image fixing properties, as well as improving the image quality and enhancing the offset of coloring material with respect to the fixing roller.

When the non-recording surface of the special paper is suctioned, the negative pressure applied by the pump 43 via the suction holes 42 can be controlled by the negative pressure control unit 147 of the control system (see FIG. 12) so as to be variable on the basis of at least one of the thickness of the special paper and the void ratio of the special paper. More specifically, the greater the thickness of the special paper, the higher the negative pressure set to be applied by the pump 43 via the suction holes 42 in order to promote the permeation of the solvent into the special paper. Furthermore, the smaller the void ratio of the special paper, the higher the negative pressure set to be applied by the pump 43 via the suction holes 42 in order to promote the permeation of the solvent into the special paper.

Moreover, in the second intermediate conveyance unit 26 and the third intermediate conveyance unit 28, by blowing hot air onto the recording surface of the special paper via air blowing apertures 36 in the intermediate conveyance body 30, the viscosity of the high-boiling-point solvent in the ink is lowered, thereby promoting its permeation into the recording medium 22, as well as promoting the drying of the residual water content in the ink.

The temperature and flow rate of the air flow from the blower 38 can be adjusted and controlled by the air flow control unit 143 of the control system (see FIG. 12), in such a manner that the reduction in the viscosity of the high-boiling-point solvent in the ink and the drying of the residual water content are promoted in an efficient fashion.

Inkjet recording apparatuses and inkjet recording methods according to embodiments of the present invention have been described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus comprising:

an inkjet head which ejects ink so as to record an image on a recording medium;

a drum-shaped member which includes a drum and is at least one of a print drum in which the inkjet head is arranged opposing a circumferential surface of the drum, a drying drum having a drying device which dries an image on a recording surface of the recording medium and which is arranged opposing the circumferential surface of the drum, and a fixing drum having a fixing device which fixes an image on the recording surface of the recording medium and which is arranged opposing the circumferential surface of the drum;

an intermediate conveyance body which holds an edge of the recording medium while moving the recording medium in rotation, and transfers the recording medium to the drum-shaped member; and a conveyance guide which guides a non-recording surface of the recording medium which is moved in rotation by the intermediate conveyance body, wherein the conveyance guide has a back tension application device which produces a force to act on the recording medium in an opposite direction to a direction of movement of the recording medium.

2. The inkjet recording apparatus as defined in claim 1, wherein the back tension application device is a pressure application device which applies a pressure to the recording medium.

3. The inkjet recording apparatus as defined in claim 2, wherein the pressure application device is a negative pressure application device which is provided in the conveyance guide and which applies a negative pressure to the non-recording surface of the recording medium.

4. The inkjet recording apparatus as defined in claim 3, comprising a negative pressure control device which controls the negative pressure applied to the recording medium by the negative pressure application device.

5. The inkjet recording apparatus as defined in claim 4, wherein the negative pressure control device controls magnitude of the negative pressure applied by the negative pressure application device in accordance with a type of the recording medium.

6. The inkjet recording apparatus as defined in claim 2, wherein the pressure application device is a positive pressure application device which is provided in the intermediate conveyance body and which applies a positive pressure to the recording surface of the recording medium.

7. The inkjet recording apparatus as defined in claim 6, wherein the positive pressure application device has a positive pressure restricting device which partially restricts the positive pressure applied to the recording surface of the recording medium.

8. The inkjet recording apparatus as defined in claim 7, comprising a positive pressure control device which controls the positive pressure applied to the recording medium by the positive pressure application device.

9. The inkjet recording apparatus as defined in claim 8, wherein the positive pressure control device controls magnitude of the positive pressure applied by the positive pressure application device in accordance with a type of the recording medium.

10. The inkjet recording apparatus as defined in claim 1, wherein the drum-shaped member has a contacting device which causes the recording medium to make close contact with the circumferential surface of the drum.

11. The inkjet recording apparatus as defined in claim 10, wherein the contacting device has a suction device which suctions the recording medium onto the circumferential surface of the drum.

* * * * *